US010944185B2

(12) United States Patent
Syrytsin et al.

(10) Patent No.: US 10,944,185 B2
(45) Date of Patent: Mar. 9, 2021

(54) WIDEBAND PHASED MOBILE ANTENNA ARRAY DEVICES, SYSTEMS, AND METHODS

(71) Applicant: wiSpry, Inc., Irvine, CA (US)

(72) Inventors: Igor Syrytsin, Aalborg (DK); Shuai Zhang, Aalborg SV (DK); Gert Frølund Pedersen, Storvorde (DK)

(73) Assignee: WISPRY, INC., Irvine, CA (US)

( * ) Notice: Subject to any disclaimer, the term of this patent is extended or adjusted under 35 U.S.C. 154(b) by 7 days.

(21) Appl. No.: 16/157,937

(22) Filed: Oct. 11, 2018

(65) Prior Publication Data

US 2019/0109386 A1 Apr. 11, 2019

Related U.S. Application Data

(60) Provisional application No. 62/570,908, filed on Oct. 11, 2017.

(51) Int. Cl.
*H01Q 9/16* (2006.01)
*H01Q 21/06* (2006.01)
(Continued)

(52) U.S. Cl.
CPC ..... *H01Q 21/067* (2013.01); *H01Q 5/357* (2015.01); *H01Q 5/371* (2015.01); *H01Q 9/16* (2013.01);
(Continued)

(58) Field of Classification Search
CPC ..... H01Q 21/067; H01Q 9/16; H01Q 21/08; H01Q 5/371; H01Q 21/29; H01Q 5/357; H01Q 25/04; H01Q 25/02; H01Q 3/34
See application file for complete search history.

(56) References Cited

U.S. PATENT DOCUMENTS 2,661,423 A * 12/1953 Middlemark ..... H01Q 3/44 343/797
6,337,666 B1 * 1/2002 Bishop ..... H01Q 9/30 343/700 MS
(Continued)

FOREIGN PATENT DOCUMENTS

CN 111201671 A 5/2020
JP 2012-054815 A 3/2012
(Continued)

OTHER PUBLICATIONS

International Search Report and Written Opinion for Application No. PCT/US2018/055470 dated Apr. 15, 2019.
(Continued)

*Primary Examiner* — Dieu Hien T Duong
(74) *Attorney, Agent, or Firm* — Jenkins, Wilson, Taylor & Hunt, P.A.

(57) ABSTRACT

Wideband phased mobile antenna array devices, systems, and methods include antenna elements arranged in a substantially linear array and positioned and adjusted on a substrate to achieve an aggregate radiation pattern in an end-fire direction. In some embodiments, each antenna element includes two pairs of antenna arms, a pair on either side of the substrate. In some embodiments, each pair of antenna arms are configured to be adjusted and positioned symmetrically to generate the end-fire radiation pattern. In some embodiments, each of the antenna elements in the linear array is spaced apart from each other by a distance that is equal to approximately λ/2, where λ is a wavelength associated with a frequency within a desired operating frequency range of the antenna system.

21 Claims, 25 Drawing Sheets

(51) Int. Cl.

| | |
|---|---|
| ***H01Q 5/357*** | (2015.01) |
| ***H01Q 25/04*** | (2006.01) |
| ***H01Q 25/02*** | (2006.01) |
| ***H01Q 21/08*** | (2006.01) |
| ***H01Q 5/371*** | (2015.01) |
| ***H01Q 21/29*** | (2006.01) |
| *H01Q 3/34* | (2006.01) |

(52) U.S. Cl.
CPC ..... *H01Q 21/08* (2013.01); *H01Q 21/29* (2013.01); *H01Q 25/02* (2013.01); *H01Q 25/04* (2013.01); *H01Q 3/34* (2013.01)

(56) References Cited

U.S. PATENT DOCUMENTS

| | | | | |
|---|---|---|---|---|
| 2007/0182656 | A1 | 8/2007 | Qi et al. | |
| 2008/0218425 | A1* | 9/2008 | Deng ..... | H01Q 3/01 343/757 |
| 2014/0138546 | A1 | 5/2014 | Iluz et al. | |
| 2014/0327591 | A1 | 11/2014 | Kokkinos | |
| 2016/0254594 | A1 | 9/2016 | Jones et al. | |

FOREIGN PATENT DOCUMENTS

| | | | |
|---|---|---|---|
| WO | WO 2008/109067 | A1 | 9/2008 |
| WO | WO 2019/075241 | A2 | 4/2019 |

OTHER PUBLICATIONS

International Search Report for Application No. PCT/US 08/02845 dated Jun. 2, 2008.

* cited by examiner

WIDEBAND PHASED MOBILE ANTENNA ARRAY DEVICES, SYSTEMS, AND METHODS

CROSS-REFERENCE TO RELATED APPLICATION

The present application claims priority to U.S. Provisional Application No. 62/570,908, filed Oct. 11, 2017, the entire disclosure of which is incorporated by reference herein.

TECHNICAL FIELD

The subject matter disclosed herein relates generally to mobile antenna systems and devices. More particularly, the subject matter disclosed herein relates to wideband phased mobile antenna arrays.

BACKGROUND

The fifth-generation mobile communications network, also known as 5G, is expected to provide a significant improvement in data transmission rates in mobile communications. Some estimates show the improvement in download speeds at between 100-1000 times faster than that of 4G/long-term evolution (LTE). In some applications, especially 5G mobile terminals, improved antenna systems are required in order to meet the demands of the higher data speeds.

In mobile terminal applications it is not only necessary to meet the throughput demands associated with 5G, but also any antenna systems of the mobile terminals must be small enough in order to meet cost and size restrictions. Furthermore, it is desirable to create an antenna system for 5G mobile terminals that is designed to balance wideband/multiband operation, wide scan angle, stable radiation patterns and a small size. Thus, disclosed hereinbelow is a wideband phased mobile antenna array system for mobile terminals that not only meet the throughput demands of 5G mobile communication networks, but are also small enough in size such that mobile terminals of the near future are not prohibitively large.

SUMMARY

In accordance with the disclosure herein, wideband phased mobile antenna array devices, systems, and methods are described. The antenna array system of the present disclosure includes a multi-mode planar antenna array, namely, a multi-mode, or quad-mode, planar antenna array. Separately, the four modes of each multi-mode antenna element would have different radiation patterns. However, when the multi-mode antenna elements are combined into an array, they have similar embedded radiation patterns. The resulting antenna array has a wide scan angle due to the wide embedded radiation pattern of its elements. As discussed hereinbelow, the Quad-Mode planar antenna array has a center frequency of about 28 GHz and a bandwidth of about +/−25% to about +/−36% of the center frequency (i.e., for example, 7-10 GHz when the center frequency is 28 GHz), or even greater, in some embodiments. In further embodiments of the present disclosure, each antenna element comprises a pair of dipole-like arms which are spaced by a slot that can have a clearance, or width, of, as small as about 0.5 mm-2 mm for the 28 GHz center frequency and bandwidth described above. In some embodiments of the present disclosure, the design may be dimensionally scaled to address a different frequency while maintaining the large fractional bandwidth.

In one aspect of the present disclosure, an antenna system is provided, the antenna system comprising: a plurality of multi-mode antenna elements arranged in an array; wherein the plurality of multi-mode antenna elements are positioned with respect to one another and configured such that radiation patterns generated by each of the plurality of multi-mode antenna elements constructively interfere with one another in one or more first direction and destructively interfere with one another in one or more second direction to achieve a desired aggregate radiation pattern.

In another aspect, the plurality of multi-mode antenna elements is arranged in a substantially linear array. In further aspects, adjacent elements of the plurality of multi-mode antenna elements are spaced apart from each other by a distance that is equal to approximately $\lambda/2$, where $\lambda$ is a wavelength associated with a frequency within a desired operating frequency range of the antenna system.

In yet another aspect of the present disclosure, an antenna element for use in a multi-mode antenna system is presented, the antenna element comprising; a first pair of antenna arms arranged on a first side of a substrate, the first pair of antenna arms being arranged at a first angle with respect to one another; a second pair of antenna arms arranged on a second side of the substrate and connected to the first pair of antenna arms, the second pair of antenna arms being arranged at a second angle with respect to one another; wherein lengths of the first pair of antenna arms, lengths of the second pair of antenna arms, the first angle, and the second angle are selected to define four antenna modes corresponding to different frequencies.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The presently disclosed subject matter can be better understood by referring to the following, example figures. The components in the figures are not necessarily to scale, emphasis instead being placed upon illustrating the principles of the presently disclosed subject matter (often schematically). In the figures, like reference numerals designate corresponding parts throughout the different views. A further understanding of the presently disclosed subject matter can be obtained by reference to an embodiment set forth in the illustrations of the accompanying drawings. Although the illustrated embodiment is merely exemplary of systems, devices, and methods for carrying out the presently disclosed subject matter, both the organization and method of operation of the presently disclosed subject matter, in general, together with further objectives and advantages thereof, may be more easily understood by reference to the drawings and the following description. The drawings are not intended to limit the scope of this presently disclosed subject matter, which is set forth with particularity in the claims as appended or as subsequently amended, but merely to clarify and exemplify the presently disclosed subject matter.

For a more complete understanding of the presently disclosed subject matter, reference is now made to the following, example drawings in which.

DETAILED DESCRIPTION

The subject matter of the present disclosure provides a multi-mode (e.g., quad-mode) planar antenna array with a wide bandwidth (e.g., up to about +/−25% to about +/−36% of the center frequency, or about 7-10 GHz or greater with a center frequency of about 28 GHz) and small clearance (e.g., about 0.5 mm to 2 mm for a center frequency of about 28 GHz). As discussed hereinabove, in some embodiments of the present disclosure, the design may be dimensionally scaled to address a different frequency while maintaining the large fractional bandwidth. Not only because of its performance, but also because of its size, in some embodiments of the present disclosure, such an array can be applicable for 5G mobile terminals. The antenna elements have four modes, each having a different radiation pattern. However, in accordance with some embodiments of the present disclosure and as discussed hereinbelow, when the antenna elements are combined into an array, they have similar embedded radiation patterns. In some embodiments, the resulting antenna array has a wide scan angle due to the wide embedded radiation pattern of the antenna elements.

A detailed description of the geometry, properties, and features of one or more multi-mode planar antenna arrays is disclosed herein. Each of the figures and descriptions discussed hereinbelow is for non-limiting exemplary purposes only. Some embodiments of the present disclosure can have the features described hereinbelow, or could have different shapes, angles, lengths, widths, etc.

Figure 1:
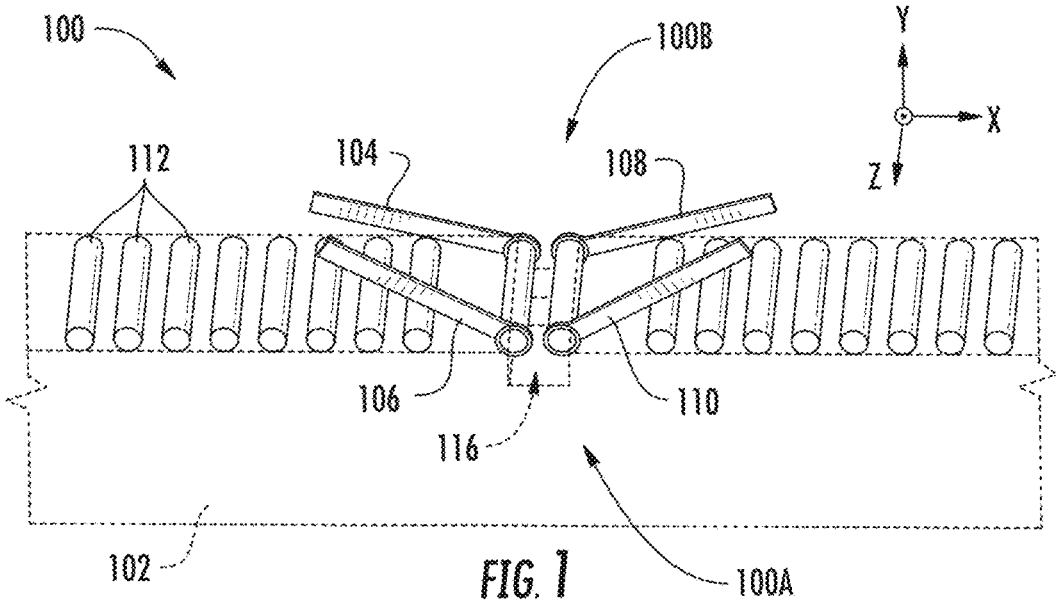
FIG. 1 illustrates a perspective side view of an antenna element having elements positioned on opposing sides of a substrate according to an embodiment of the presently disclosed subject matter.
Figure 2A:
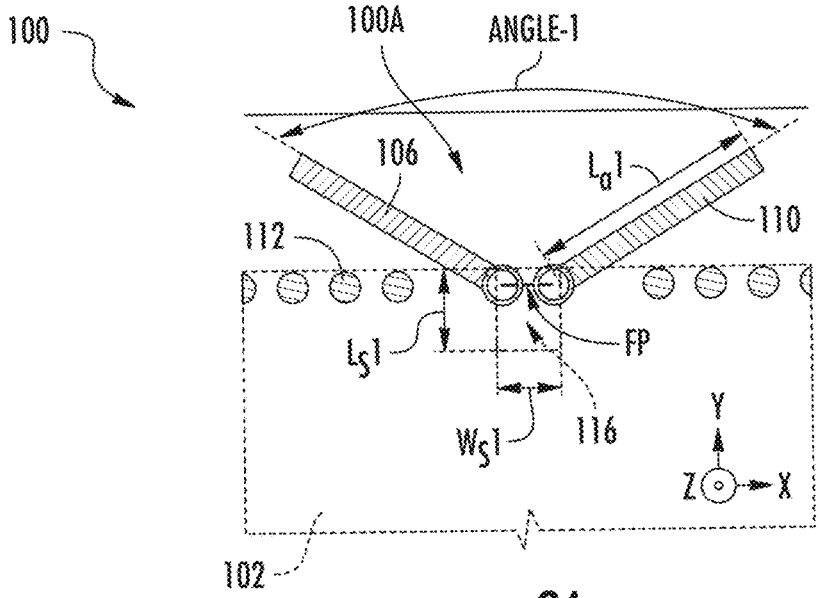
FIG. 2A illustrates a top view of an antenna element on a printed circuit board (PCB) according to an embodiment of the presently disclosed subject matter.
Figure 2B:
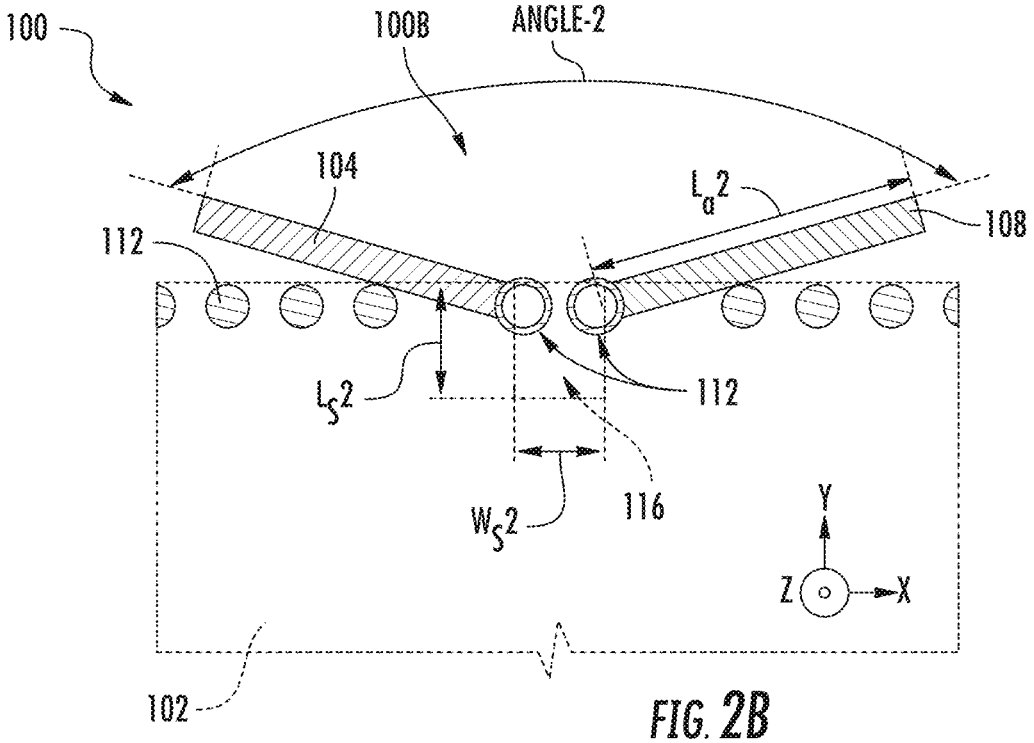
FIG. 2B illustrates a bottom view of an antenna element on the PCB according to an embodiment of the presently disclosed subject matter.

FIGS. 1-2B of the drawings illustrate the geometry of the proposed multi-mode antenna element 100, which can be used in an antenna array as discussed below. FIG. 1 illustrates a perspective side view of the antenna element 100, which includes a top side 100*a* of the antenna element 100 on the substrate 102, a bottom side 100*b* of the antenna element 100, a substrate 102, first antenna arm 104, second antenna arm 106, third antenna arm 108, fourth antenna arm 110, and a plurality of vias 112. In some embodiments of the present disclosure, the substrate 102 is comprised of a dielectric material. In some embodiments, the antenna element 100 has a pair of antenna arms (e.g., formed in conductor layers) on both sides of the substrate 102 (e.g., second antenna arm 106 and fourth antenna arm 110 on one side of the substrate 102 and first antenna arm 104 and third antenna arm 108 on the opposite side). In some embodiments, each of the antenna arms, first antenna arm 104, second antenna arm 106, third antenna arm 108, and fourth antenna arm 110 are configured as dipole antenna elements.

In some embodiments of the present disclosure, a subset of the antenna arms can be referred to as pairs of arms. For non-limiting example, a first pair of antenna arms can comprise second antenna arm 106 and fourth antenna arm 110, and a second pair of antenna arms can comprise first antenna arm 104 and third antenna arm 108. In the illustrated embodiment of FIG. 1, the substrate 102 is shown transparently so that each pair of arms and the vias 112 therebetween are visible. A directional legend is provided to help orient those of ordinary skill in the art as to which perspective a viewer is observing. In this perspective, the x-axis and the y-axis run perpendicular to the vias 112. The z-axis runs parallel to the vias 112. To help better visualize FIGS. 2A and 2B, the directional legend is shown as well.

FIG. 2A illustrates the top side 100*a* of the proposed antenna element 100 on the substrate 102. In the illustrated embodiment, second antenna arm 106 and fourth antenna arm 110 of a first of the two pairs of antenna arms are connected in parallel by vias 112 through the substrate 102 to corresponding arms of a second of the two pairs of antenna arms (first antenna arm 104 and third antenna arm 108 depicted in FIG. 2B and discussed below). For example, in some embodiments, second antenna arm 106 is connected by a via 112 to first antenna arm 104 and fourth antenna arm 110 is connected by a via 112 to third antenna arm 108. FIGS. 2A and 2B each show only one side of the substrate 102 and one of the pairs of arms. In some embodiments, the antenna element 100 can be fed from one side, such as is shown in FIG. 2A. For example, in some embodiments, the antenna element 100 can be fed on the top side 100*a* by a differential stripline (e.g., connected to a coaxial cable or phase shifter module). The differential stripline can connect to the antenna element 100 via the feeding point FP. Additionally, second antenna arm 106 and fourth antenna arm 110 are connected to the substrate 102 at least partially within the slot 116.

FIG. 2B illustrates a bottom side 100*b* of the proposed antenna element 100 on the substrate 102. In some embodiments, the two conductor layers of the substrate 102 are connected with vias 112, such as is shown in FIGS. 1 and 2B. In the illustrated embodiment, first antenna arm 104 and third antenna arm 108 of a second of the two pairs of antenna arms are connected in parallel by vias 112 through the substrate 102 to corresponding arms of the first of the two pairs of antenna arms (second antenna arm 106 and fourth antenna arm 110 depicted in FIG. 2A and discussed above).

Referring now to both FIGS. 2A and 2B, in some embodiments of the present disclosure first antenna arm 104, second antenna arm 106, third antenna arm 108, and fourth antenna arm 110, operate individually, meaning each antenna arm can be angled or otherwise positioned separately. In other embodiments, first antenna arm 104, second antenna arm 106, third antenna arm 108, and fourth antenna arm 110, operate symmetrically, meaning, that each of the pairs of antenna arms are positioned or angled symmetrically with respect to substrate 102. For non-limiting example, in some embodiments, the first pair of antenna arms (e.g., second antenna arm 106 and fourth antenna arm 110) are angled and positioned symmetrically. In some embodiments, the second pair of antenna arms (e.g., first antenna arm 104 and third antenna arm 108) are angled and positioned symmetrically. To that end, in some embodiments, second antenna arm 106 and fourth antenna arm 110 have a first arm length $L_a$1 and first antenna arm 104 and third antenna arm 108 have a second arm length $L_a$2. Furthermore, first angle ANGLE_1 is an angle formed by the positions of second antenna arm 106 and fourth antenna arm 110, and second angle ANGLE_2 is an angle formed by the positions of first antenna arm 104 and third antenna arm 108. The resonant frequency of the four antenna modes can be controlled by changing the first arm length $L_a$1 and the second arm length $L_a$2 of the antenna arms.

As will be discussed more thoroughly hereinbelow, in some embodiments of the present disclosure, the antenna element 100 comprises four antenna modes. In some embodiments of the present disclosure, the resonant frequency of the four antenna modes can be controlled by changing the angles, first angle ANGLE_1 and second angle ANGLE_2 between the antenna arms. Further details of how changing first angle ANGLE_1 and second angle ANGLE_2 alter the resonant frequency of the four antenna modes are provided below in the discussion of FIGS. 6A-7F.

In some embodiments, slot 116 comprises dimensions, including, in the top side 100*a*, first slot length Ls1 and first slot width Ws1, and in the bottom side 100*b*, second slot length $L_s$2 and second slot width $W_s$2. Impedance matching of the four antenna modes can be controlled by changing the first slot length Ls1, the second slot length Ls2, first slot width $W_s$1, and second slot width Ws2 of the slot 116. In some embodiments of the present disclosure, the first slot length Ls1 and the second slot length Ls2 are equal to each other. In other embodiments of the present disclosure, the first slot length Ls1 and the second slot length Ls2 are not equal to each other. In some embodiments of the present disclosure, the first slot width Ws1 and the second slot width Ws2 are equal to each other. In other embodiments of the present disclosure, the first slot width Ws1 and the second slot width Ws2 are not equal to each other.

Figure 3:
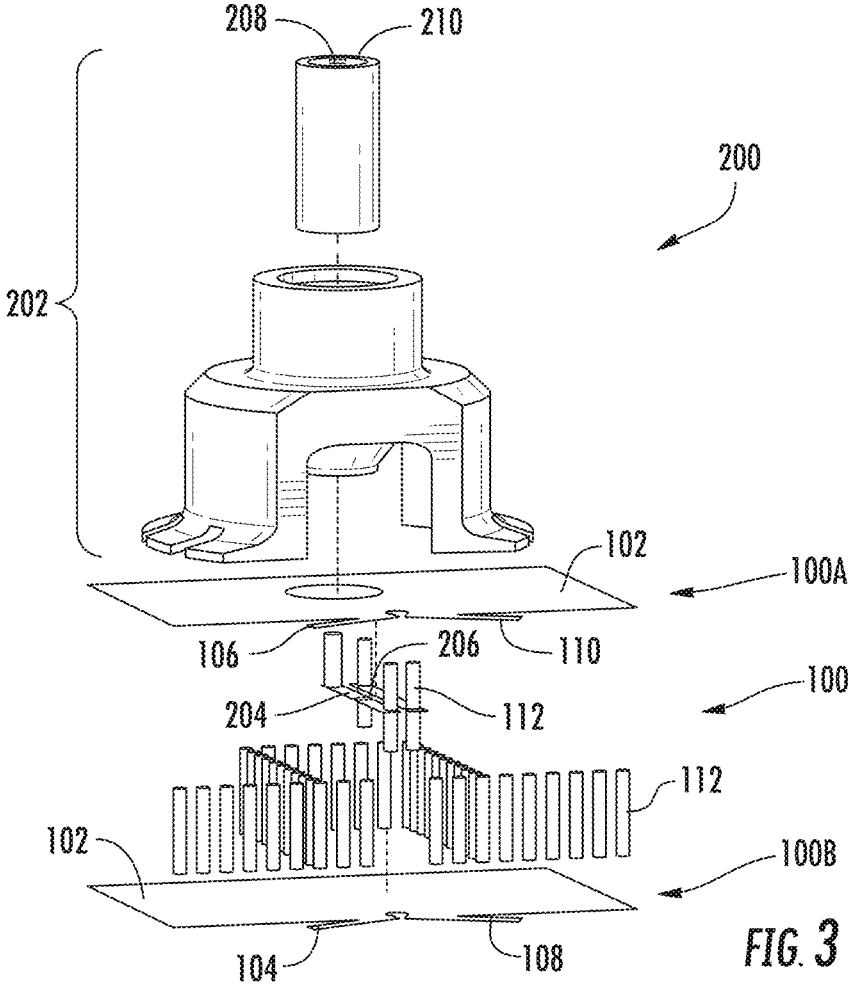
FIG. 3 illustrates an exploded perspective view of an arrangement of an antenna element configured for connection with a coaxial cable according to an embodiment of the presently disclosed subject matter.

FIG. 3 illustrates an arrangement 200 of an antenna element 100 connected, for non-limiting example, with a coaxial cable 202 as a feedline. In this arrangement 200, the first pair of antenna arms (e.g., second antenna arm 106 and fourth antenna arm 110) and the second pair of antenna arms (e.g., first antenna arm 104 and third antenna arm 108) of the antenna element 100 are positioned on either side of the substrate 102, with a center conductor 204 provided in the middle of the substrate. The coaxial cable 202 is single-ended but the stripline center conductor 204 in the middle of the substrate 102 is a balun. In some embodiments, the inner conductor 208 of the coaxial cable 202 connects to the stripline center conductor 204 and the outer conductor 210 of the coaxial cable 202 connects to the stripline outer conductor 206. In some embodiments of the present disclosure, those of ordinary skill in the art will recognize that if the feed from the driving circuits (not shown) is single-ended (e.g. microstrip), a balun would be needed, although the particular design can vary from the one shown in FIG. 3. Alternatively, in other embodiments, if the feed from the driving circuits is balanced or differential, the balun would not be needed. In some embodiments of the present disclosure a coaxial cable (as shown in FIG. 3 for non-limiting example) is used as a feedline. In other embodiments of the present disclosure, other devices can be used as a feedline, depending on the application of the antenna element 100.

Figure 4:
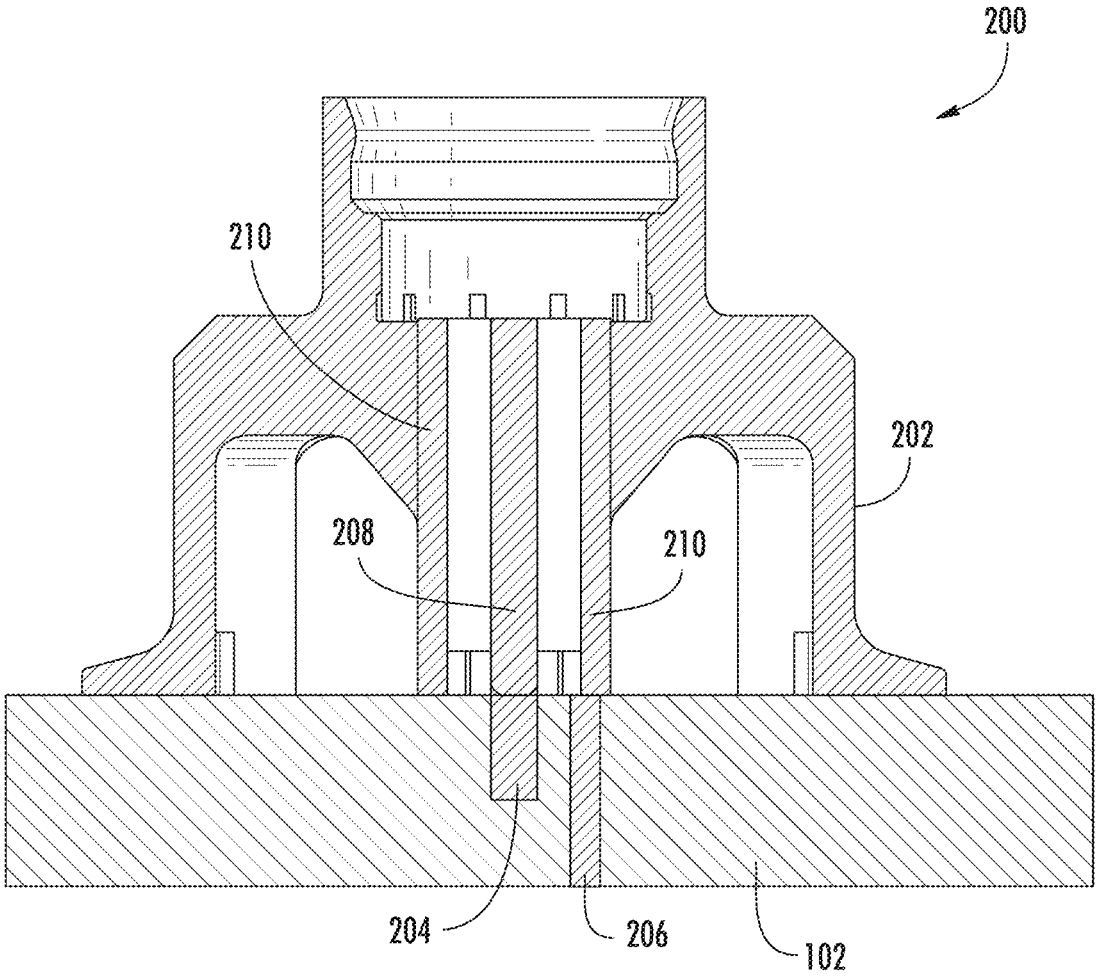
FIG. 4 illustrates a side cutaway view of an antenna element connected with a coaxial cable according to an embodiment of the presently disclosed subject matter.

FIG. 4 illustrates a zoomed-in arrangement 200 of the substrate 102 connected, for non-limiting example, with a coaxial cable 202. In this view, the antenna element 100, as well as the first antenna arm 104, the second antenna arm 106, the third antenna arm 108, and the fourth antenna arm 110 of the antenna element 100, are not visible. As shown in FIG. 4, the inner conductor 208 of the coaxial cable 202 connects to the stripline center conductor 204 and the outer conductor 210 of the coaxial cable 202 connects to the stripline outer conductor 206. In some embodiments of the present disclosure, the outer conductor 210 of the coaxial cable 202 is offset from the stripline outer conductor 206. In some embodiments, this offset is required for proper impedance matching of the antenna device. However, in other embodiments, such an offset is not required.

Figure 5A:
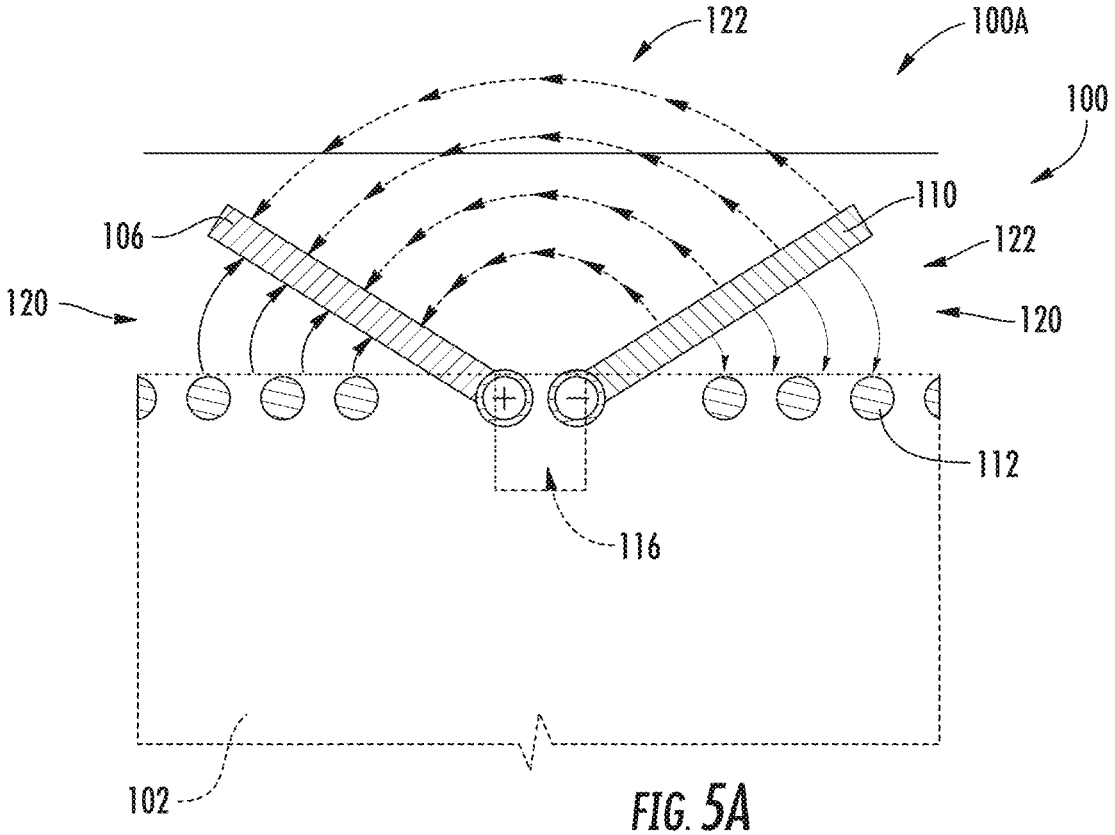
FIG. 5A illustrates a top view identifying positions of a first pair of arms of an antenna element corresponding to two frequency modes of an associated antenna according to an embodiment of the presently disclosed subject matter.
Figure 5B:
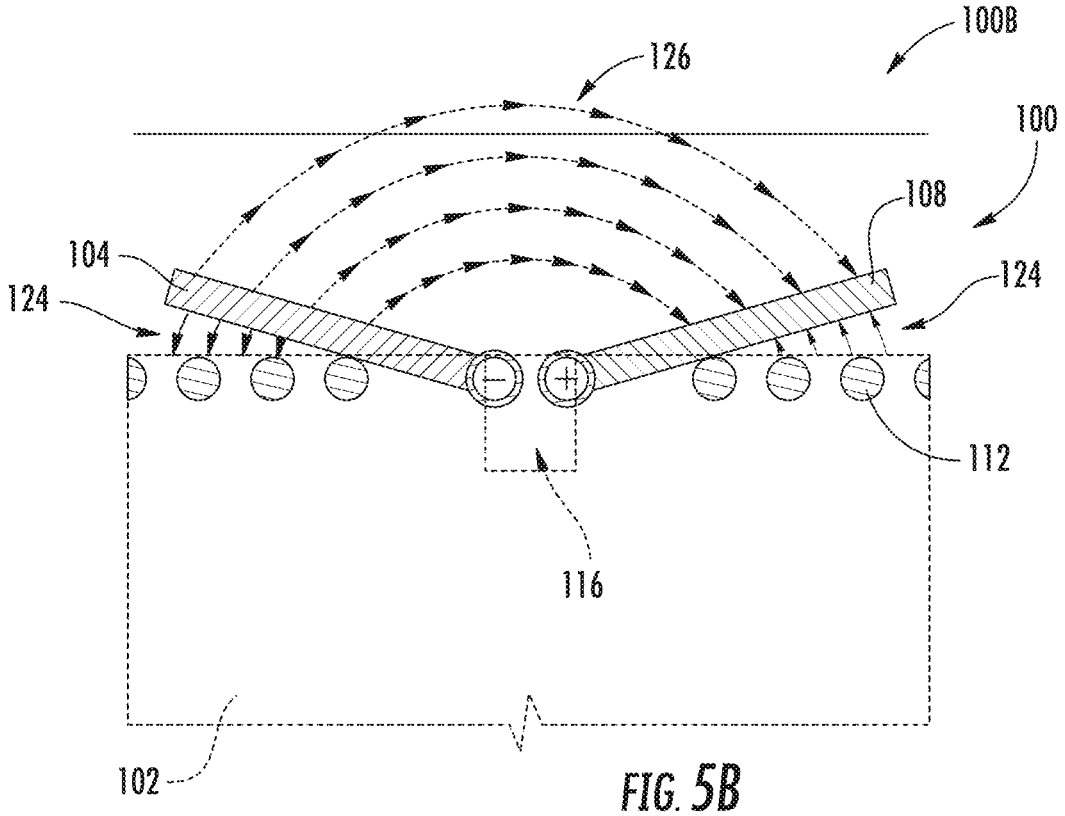
FIG. 5B illustrates a bottom view identifying positions of a second pair of arms of an antenna element corresponding to two frequency modes of an associated antenna according to an embodiment of the presently disclosed subject matter.

As illustrated in FIGS. 5A and 5B, in some embodiments, the antenna element 100 is operable at different modes corresponding to different frequencies, with different modes having different current distributions and different radiation patterns. FIG. 5A shows the top side 100*a* of the antenna element 100. In this exemplary embodiment a first mode, represented by first arrows 120, can be defined by the current distribution and radiation pattern generated between the first pair of antenna arms (e.g., second antenna arm 106 and fourth antenna arm 110) and the substrate 102. In some embodiments of the present disclosure, a second mode, represented by second arrows 122, can be defined by the current distribution and radiation pattern generated between the first pair of antenna arms (e.g., second antenna arm 106 and fourth antenna arm 110). FIG. 5B shows the bottom side 100*b* of the antenna element 100. In this exemplary embodiment, a third mode, represented by third arrows 124, can be defined by the current distribution and radiation pattern generated between the second pair of antenna arms (e.g., first antenna arm 104 and third antenna arm 108) and the substrate 102. In some embodiments of the present disclosure, a fourth mode, represented by fourth arrows 126, can be defined by the current distribution and radiation pattern generated between the second pair of antenna arms (e.g., first antenna arm 104 and third antenna arm 108).

In some embodiments of the present disclosure, the resonant frequency of the four antenna modes, which are represented in FIGS. 5A-B by first arrows 120, second arrows 122, third arrows 124, and fourth arrows 126 can be controlled by changing the first angle ANGLE_1 formed by the positions of arms 106 and 110 and the second angle ANGLE_2 formed by the positions of arms 104 and 108. In some embodiments, when the antenna element 100 is resonating in antenna modes 1 and 3, represented by first arrows 120 and third arrows 124, respectively, an electric field is present between each of first antenna arm 104 and third antenna arm 108 and the ground plane. When the antenna element 100 is resonating in antenna modes 2 and 4, represented by second arrows 122 and fourth arrows 124, an electric field of a dipole-like nature is present between second antenna arm 106 and fourth antenna arm 110.

In some embodiments, as will be discussed further hereinbelow, in order to obtain the desired performance of the antenna element 100, the second arm length $L_a$2 of second antenna arm 106 and fourth antenna arm 110 and the first arm length $L_a$1 of first antenna arm 104 and third antenna arm 108 should be chosen to obtain two lower and two higher resonances. The position of the resonances can be adjusted by changing first angle ANGLE_1 and second angle ANGLE_2. In some embodiments, the second angle ANGLE_2 is adjusted first, since it mainly changes antenna modes 3 and 4, represented by third arrows 124 and fourth arrows 126, respectively, and ultimately affects antenna modes 1 and 2, represented by first arrows 120 and second arrows 122, respectively. The first angle ANGLE_1 is adjusted next since it mainly varies antenna modes 1 and 2, represented by first arrows 120 and second arrows 122, respectively. Finally, the matching of the antenna modes can be fine-tuned by altering the dimensions of the notches 116, the first slot length Ls1, the second slot length Ls2, the first slot width Ws1, and the second slot width Ws2.

Figure 6A:
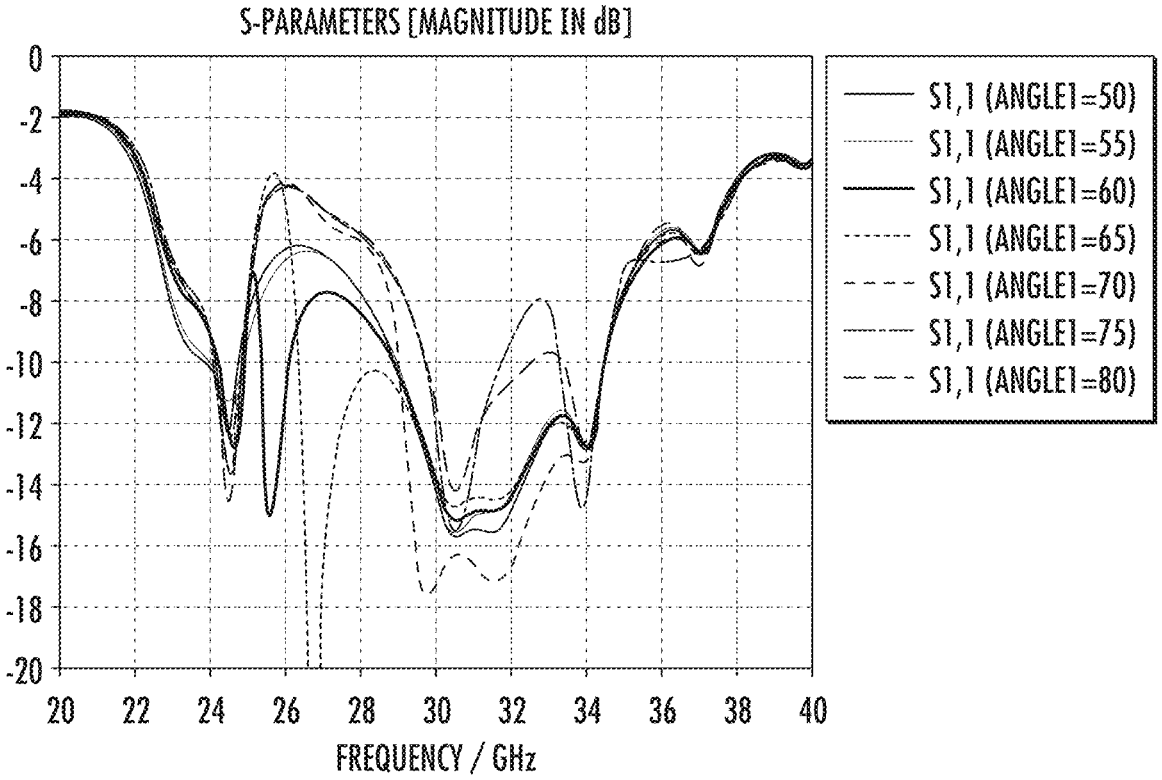
FIG. 6A is a graph illustrating the effect on the reflection coefficient over frequency of changing the angle between a first pair of antenna arms according to an embodiment of the presently disclosed subject matter.
Figure 6B:
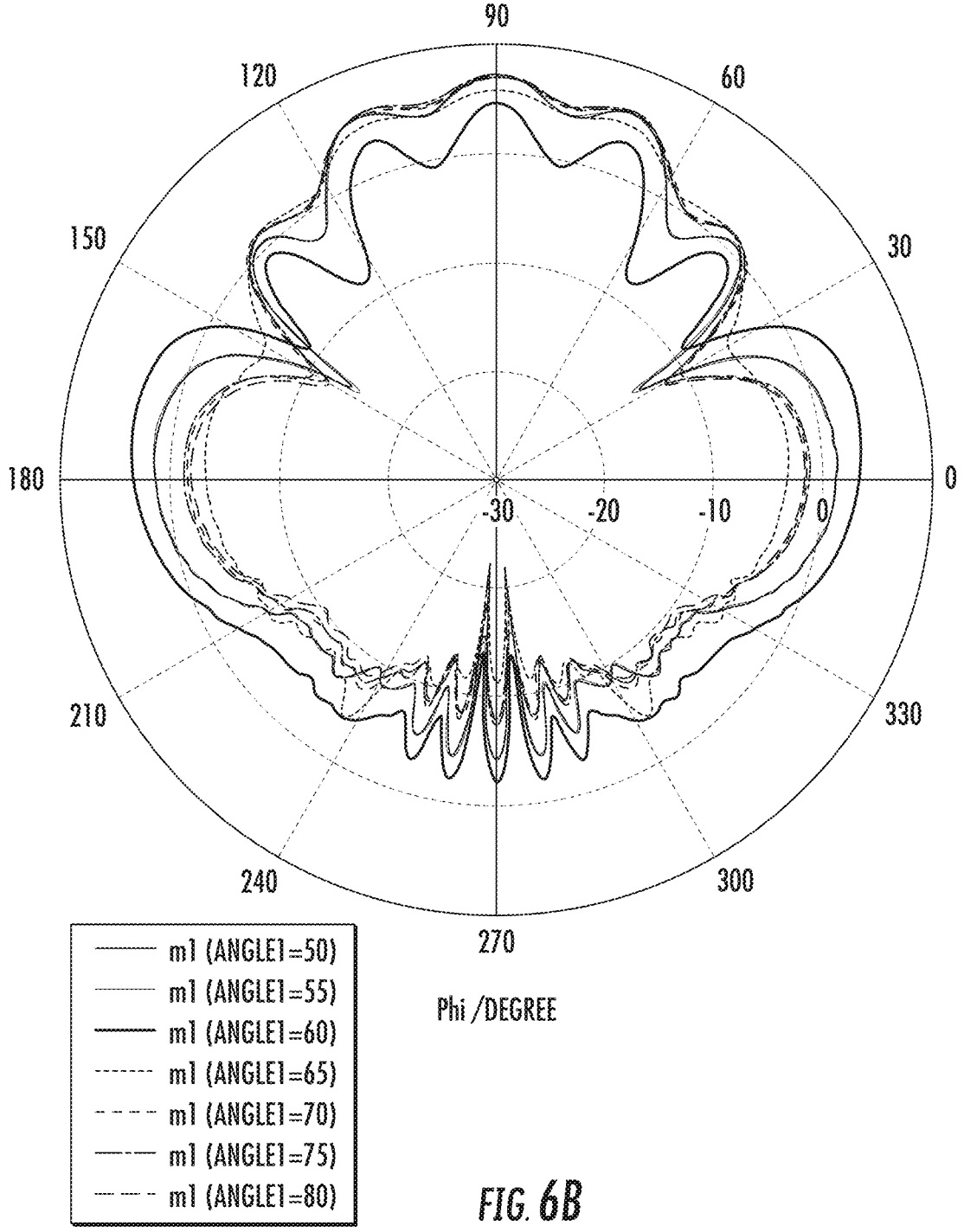
FIGS. 6B-6E are graphs at different frequencies of interest illustrating the effect on the radiation pattern of each mode by changing the angle between a first pair of antenna arms according to an embodiment of the presently disclosed subject matter.
Figure 6C:
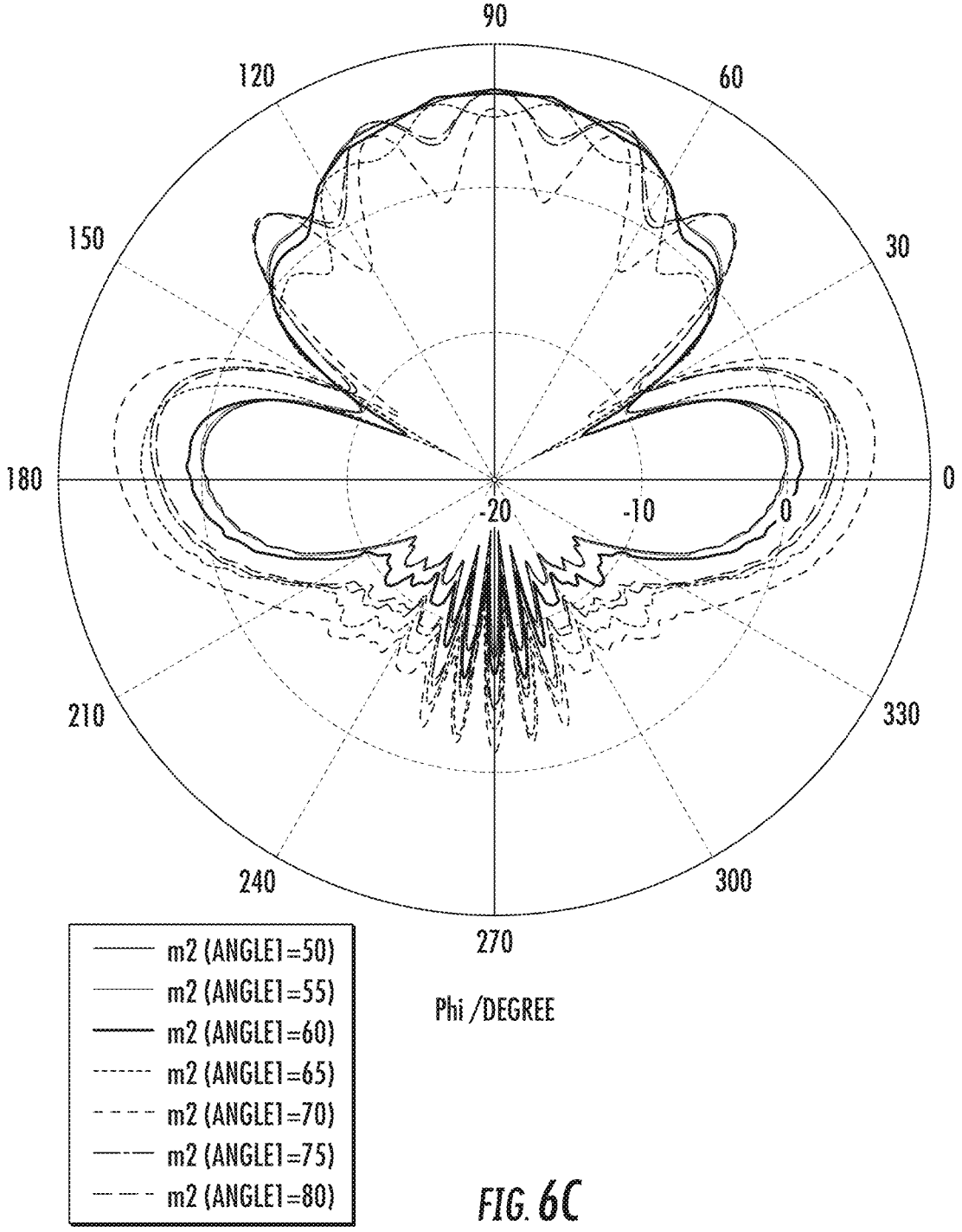
Figure 6D:
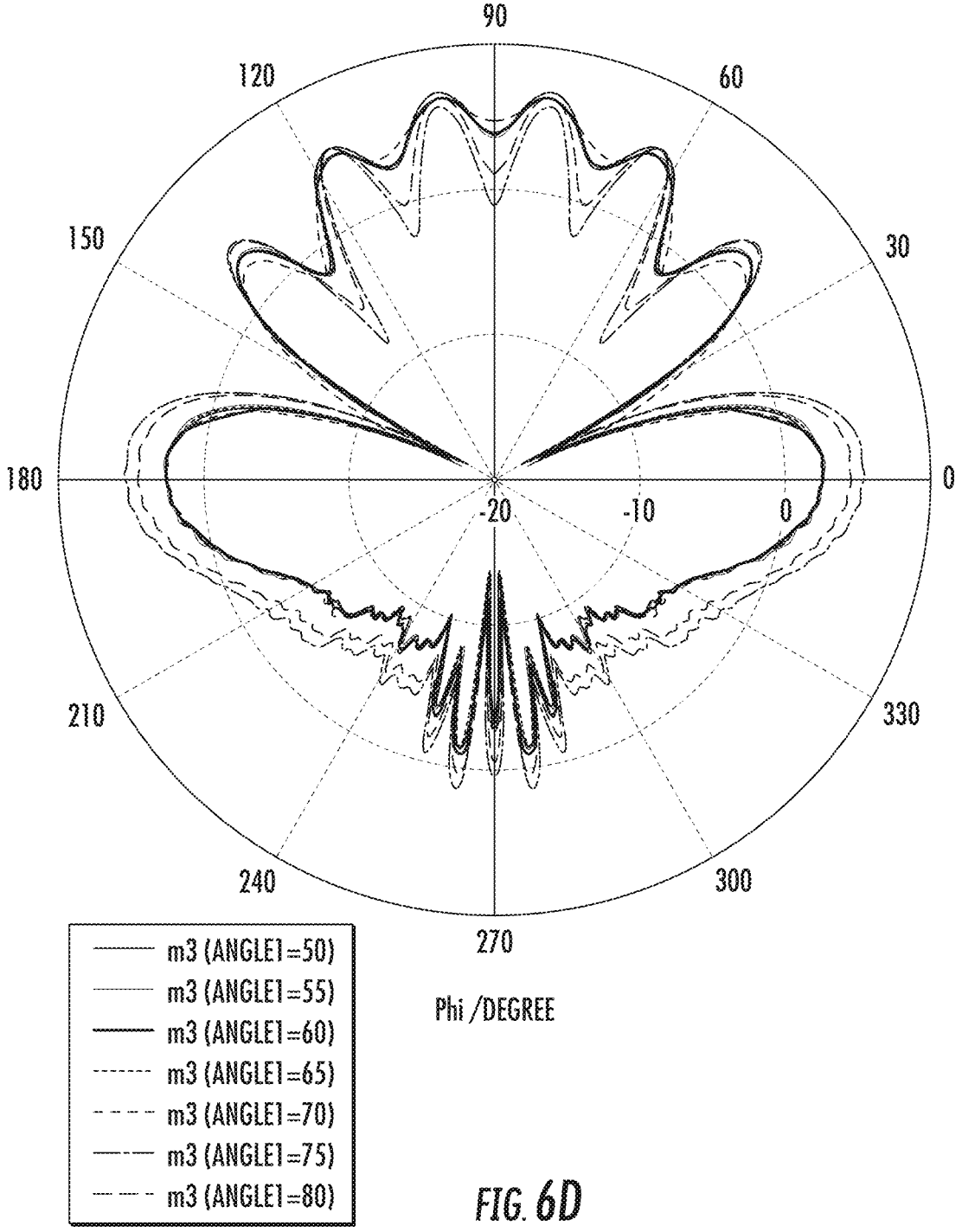
Figure 6E:
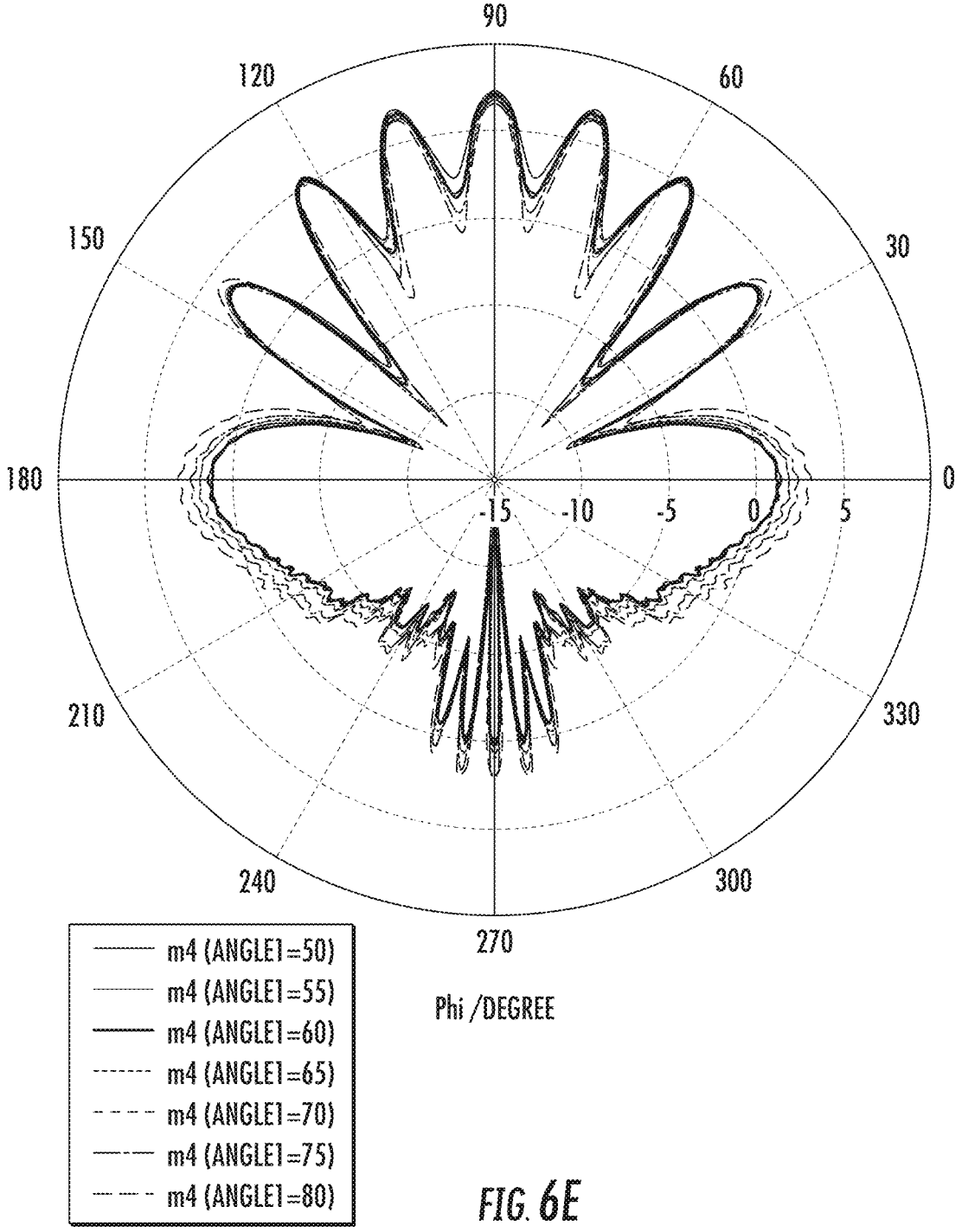

For non-limiting example, FIG. 6A illustrates the effect on the reflection coefficient of the antenna element 100 by changing the first angle ANGLE_1 formed by the positions of arms 106 and 110. In FIG. 6A, the graphs illustrate the magnitude of the reflection coefficient (in dB) of the antenna system 100 as the first angle ANGLE_1 is increased from 50 degrees to 80 degrees, in 5 degree increments.

Figure 6F:
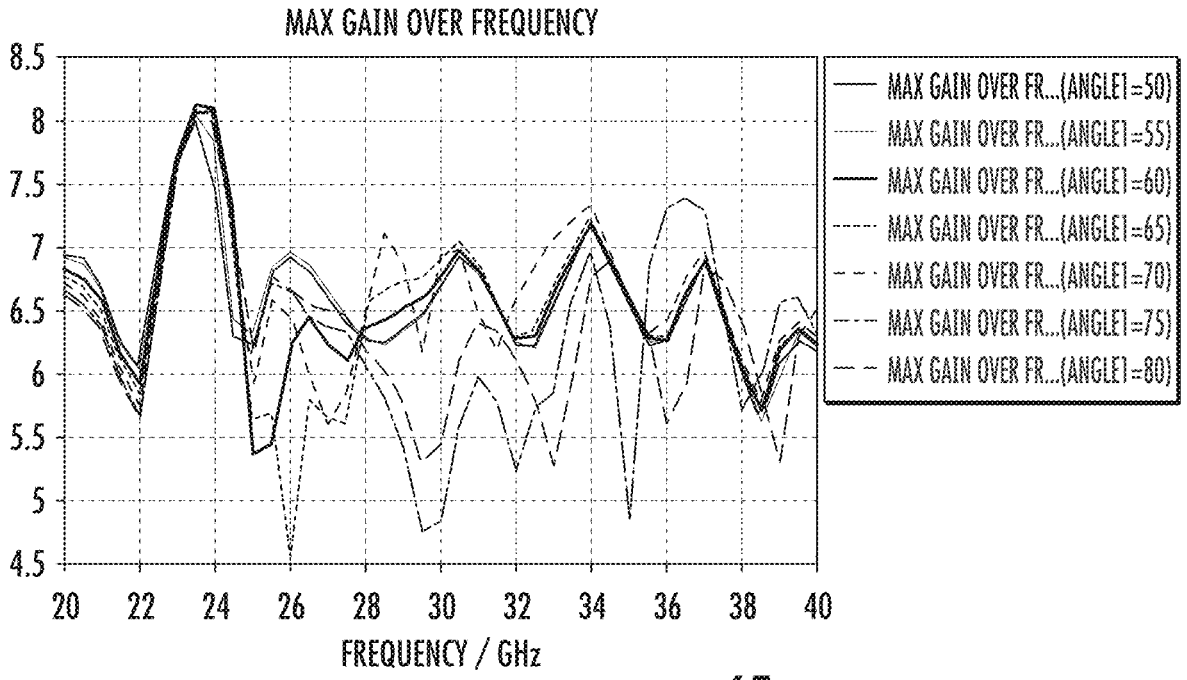
FIG. 6F is a graph illustrating a change in maximum gain over frequency by changing the angle between a first pair of antenna arms according to an embodiment of the presently disclosed subject matter.

FIGS. 6B-6E illustrate the effect on the radiation pattern of each of the four antenna modes, represented by first arrows 120 in FIG. 5A, second arrows 122 in FIG. 5A, third arrows 124 in FIG. 5B, and fourth arrows 126 in FIG. 5B, respectively, by increasing the first angle ANGLE_1 from 50 degrees to 80 degrees, in 5 degree increments. FIG. 6F illustrates the change in the maximum gain over frequency of the antenna element 100 by increasing the first angle ANGLE_1 from 50 degrees to 80 degrees, in 5 degree increments.

Figure 7A:
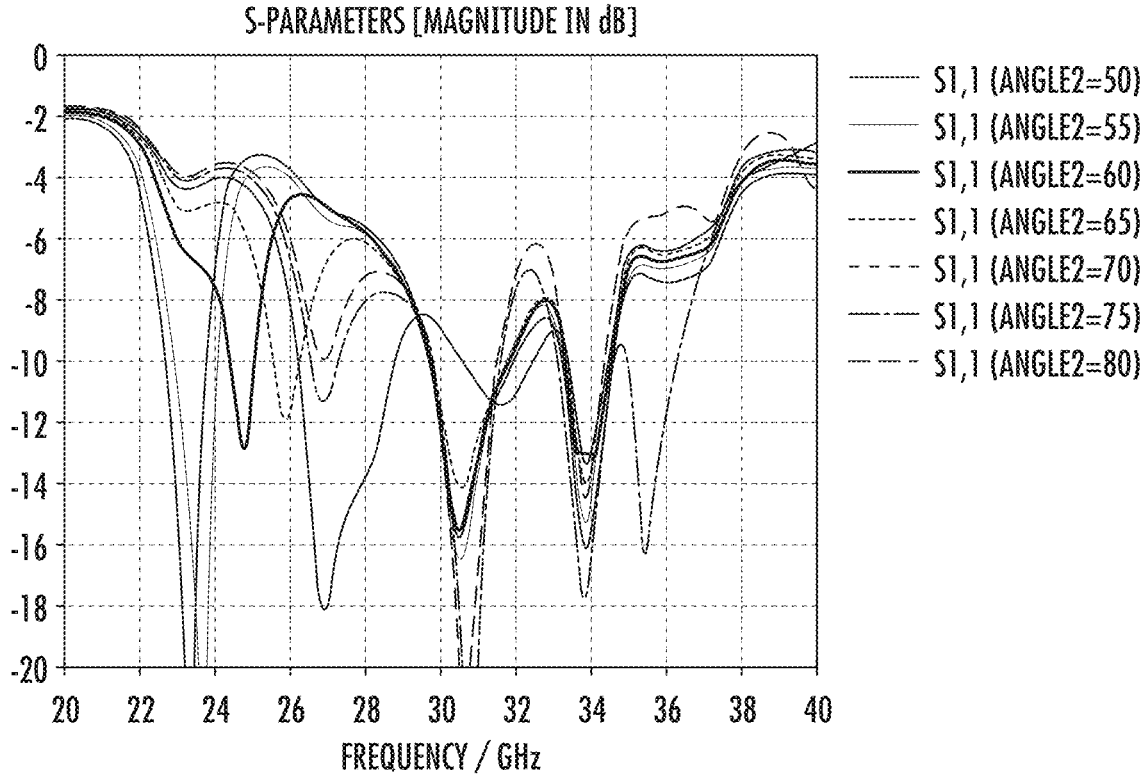
FIG. 7A is a graph illustrating the effect on the reflection coefficient over frequency of changing the angle between a second pair of antenna arms according to an embodiment of the presently disclosed subject matter.
Figure 7B:
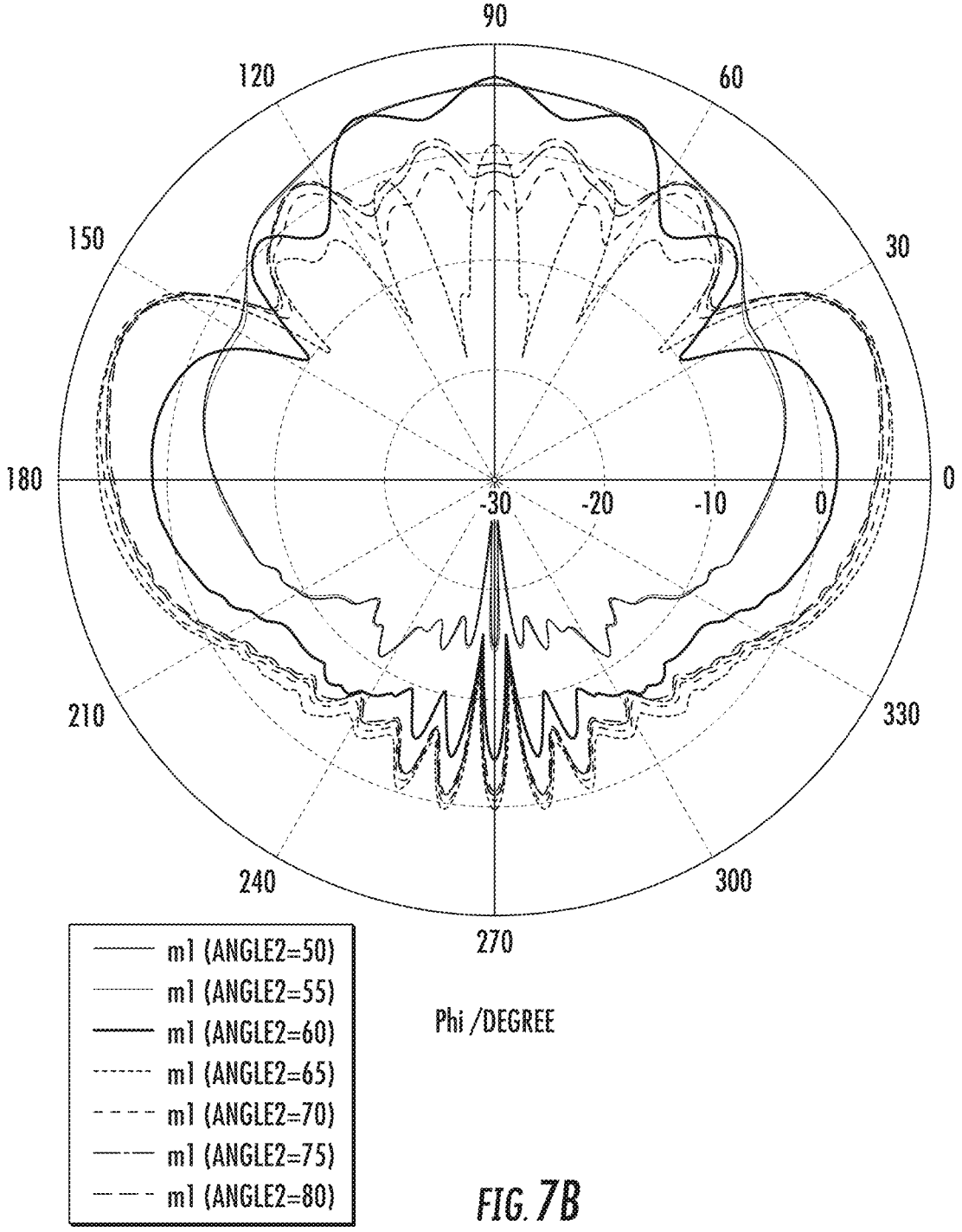
FIGS. 7B-7E are graphs at different frequencies of interest illustrating the effect on the radiation pattern of each mode by changing the angle between a second pair of antenna arms according to an embodiment of the presently disclosed subject matter.
Figure 7C:
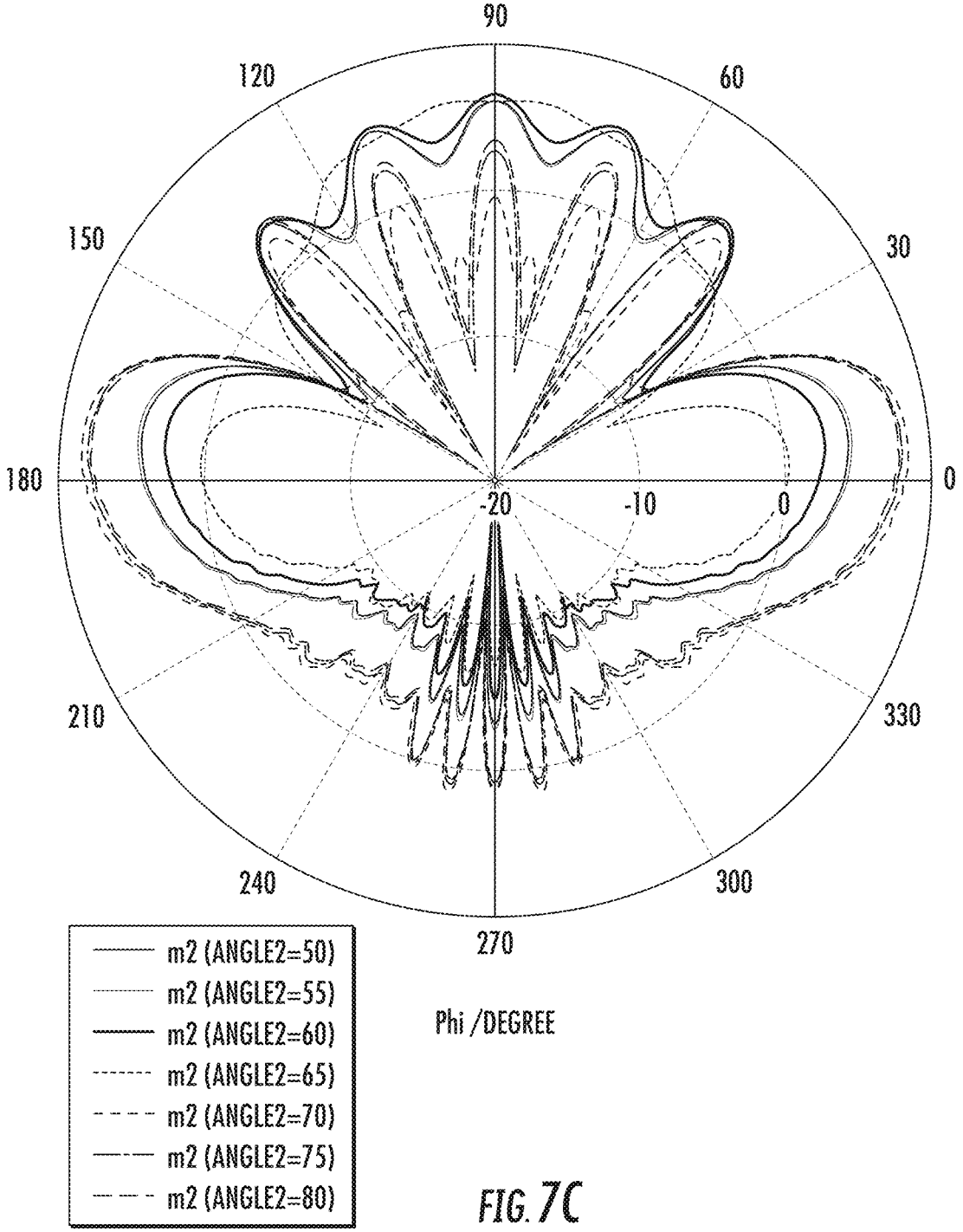
Figure 7D:
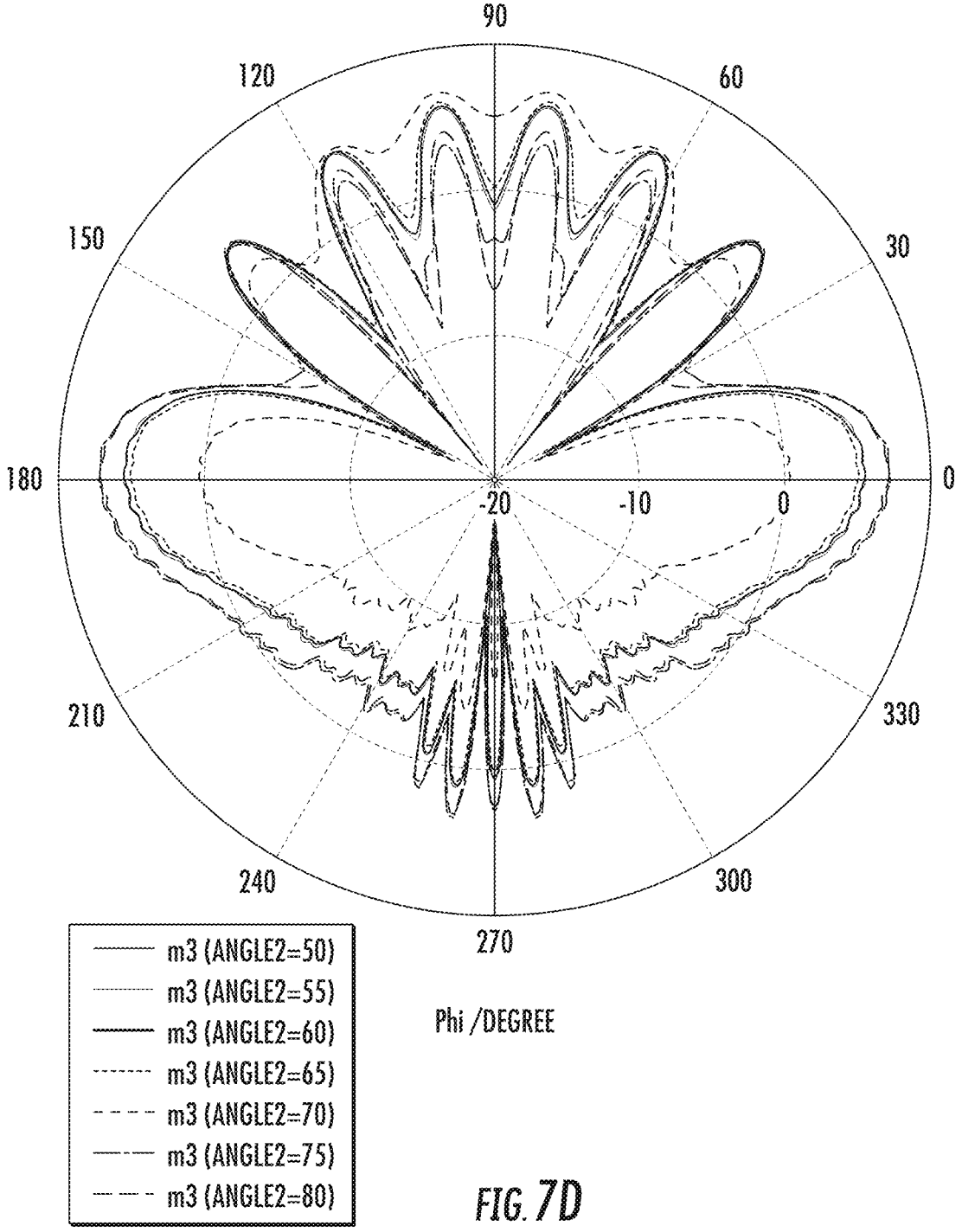
Figure 7E:
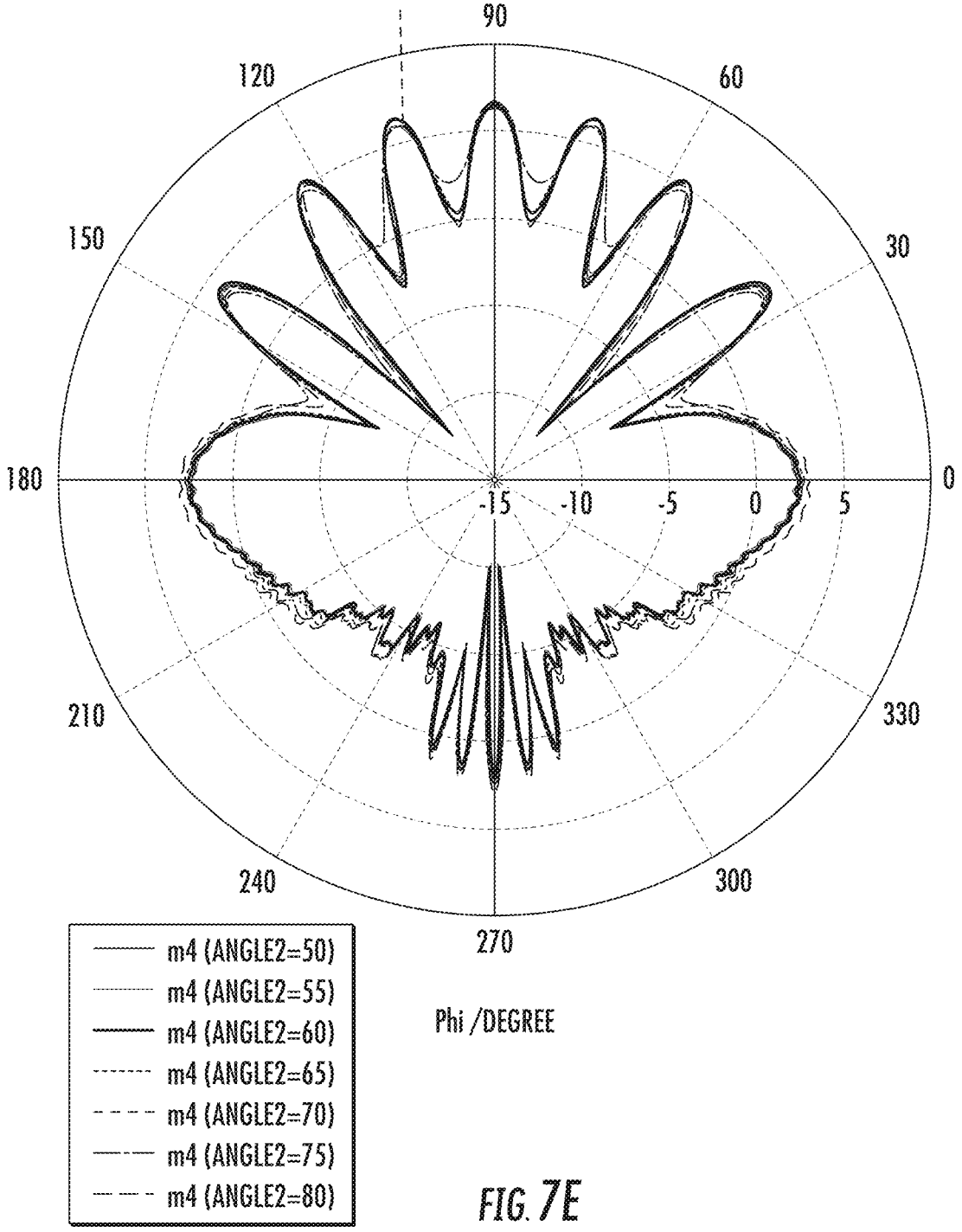
Figure 7F:
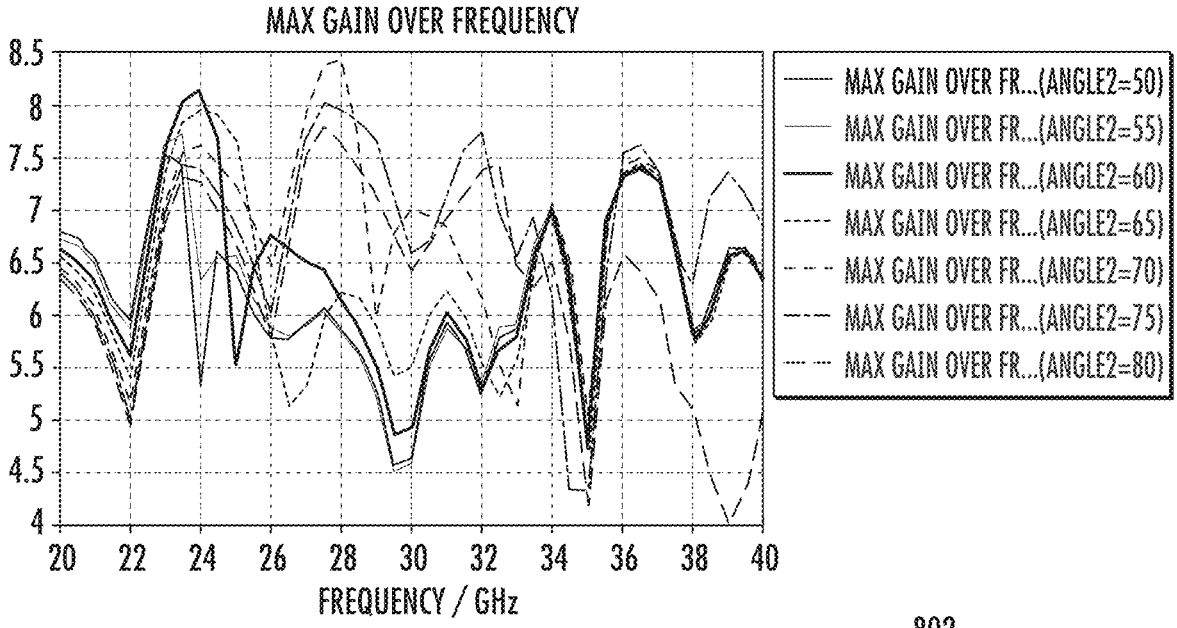
FIG. 7F is a graph illustrating a change in maximum gain over frequency by changing the angle between a second pair of antenna arms according to an embodiment of the presently disclosed subject matter.

In FIG. 7A, the graphs illustrate the magnitude of the reflection coefficient (in dB) of the antenna system 100 as the second angle ANGLE_2 is increased from 50 degrees to 80 degrees, in 5 degree increments. FIGS. 7B-7E illustrate the effect on the radiation pattern of each of the four antenna modes, represented by first arrows 120, second arrows 122, third arrows 124, and fourth arrows 126 in FIGS. 5A-5B, respectively, by increasing the second angle ANGLE_2 from 50 degrees to 80 degrees, in 5 degree increments. FIG. 7F illustrates the change in maximum gain over frequency of the antenna element 100 by increasing the second angle ANGLE_2 from 50 degrees to 80 degrees, in 5 degree increments.

As discussed hereinabove, in further embodiments of the present disclosure, the resonant frequency of the four antenna modes, represented by first arrows 120, second arrows 122, third arrows 124, and fourth arrows 126 in FIGS. 5A-5B, can be controlled by changing the first arm length $L_a$1 and the second arm length $L_a$2. In some embodiments, for example, the first arm length $L_a$1 and the second arm length $L_a$2 are generally sized to set the low end of the desired band. Furthermore, in some of the embodiments discussed hereinabove, there are other geometries such as, for example, the first angle ANGLE_1, the second angle ANGLE_2, the first slot width $W_s$1, the second slot width $W_s$2, the first slot length $L_s$1, and the second slot length $L_s$2, that are affected by changes in the first arm length $L_a$1 and the second arm length $L_a$2.

Additionally, in some embodiments, impedance matching can be controlled by changing the configuration of the substrate 102 regarding the way in which the antenna elements are mounted to the substrate 102. As illustrated in FIGS. 1-2B, and discussed hereinabove, each of the antenna arms first antenna arm 104, second antenna arm 106, third antenna arm 108, and fourth antenna arm 110, are mounted on either side of the slot 116 formed in the edge of the substrate 102. By changing the dimensions of the slot 116 on the top side 100*a* of the substrate 102, including the first slot length $L_s$1 and the first slot width $W_s$1, and the slot 116 on the bottom side 100*b* of the substrate 102, including the second slot length $L_s$2 and the second slot width $W_s$2, the impedance match can be adjusted. In some embodiments, the antenna element 100 has a very small clearance, or a first slot width $W_s$1 and/or second slot width $W_s$2, of about 0.5 mm. In some embodiments, the antenna element 100 has a very small clearance, or a first slot width $W_s$1 and/or second slot width $W_s$2, of about 1.2 mm. In still other embodiments, the antenna element 100 has a very small clearance, or first slot width $W_s$1 and/or second slot width $W_s$2, of about 0.5 mm-2 mm. In further embodiments of the present disclosure, the first slot length $L_s$1 and/or the second slot length $L_s$2 are about 0.5 mm-0.8 mm.

Figure 8A:
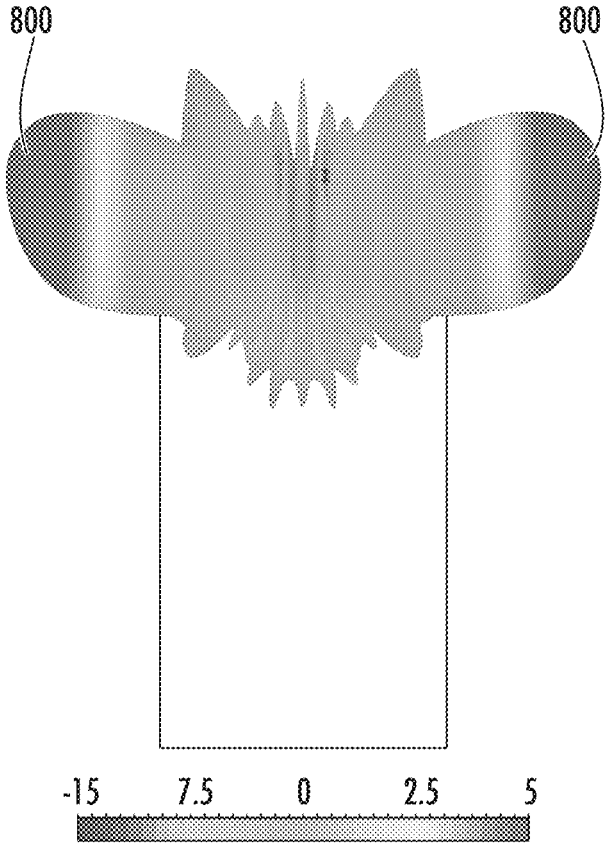
FIGS. 8A-8D are graphs illustrating radiation patterns of an antenna element operating in various modes according to an embodiment of the presently disclosed subject matter.
Figure 8B:
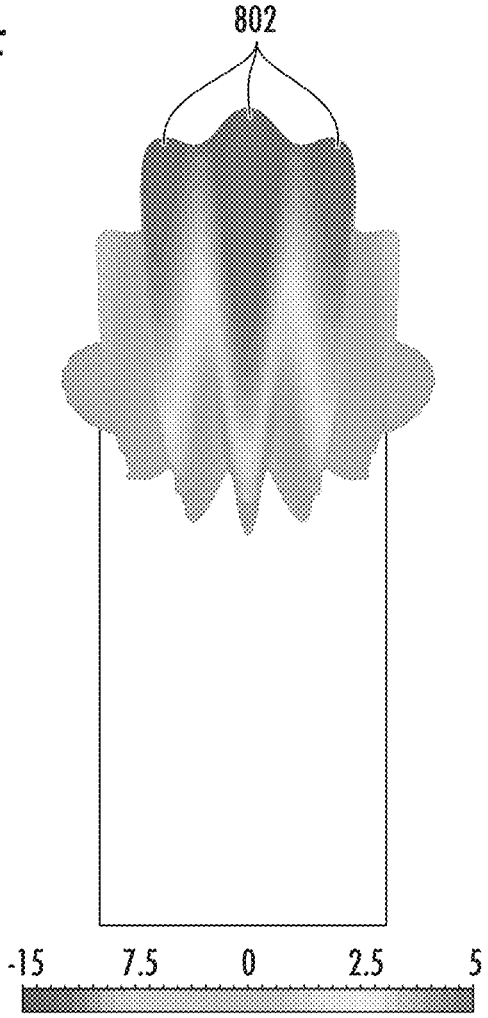
Figure 8C:
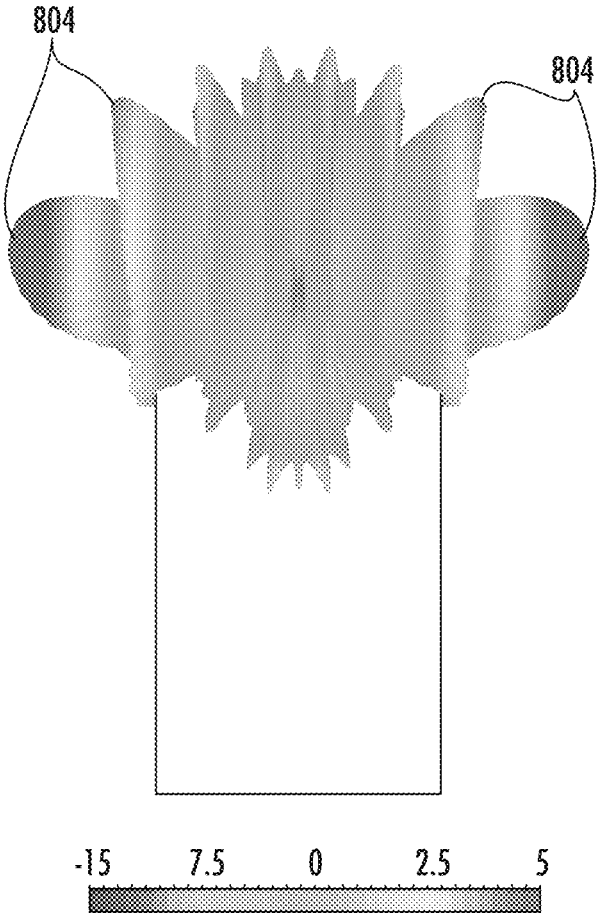
Figure 8D:
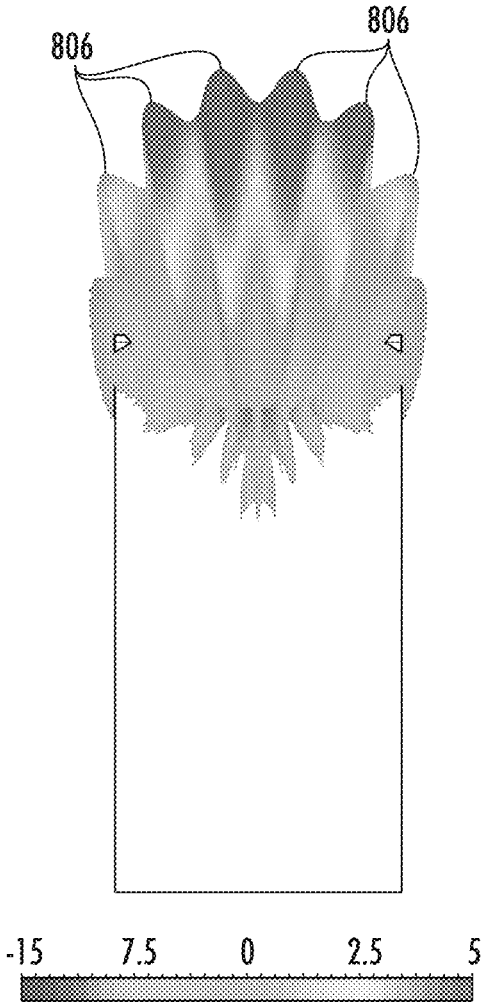

The radiation patterns of an exemplary antenna element 100 are shown in FIGS. 8A-8D. As illustrated in FIGS. 8A-8D, for example, radiation patterns for antenna element 100 can exhibit a maximum relative power gain, generally designated 800 in FIG. 8A, 802 in FIG. 8B, 804 in FIG. 8C, and 806 in FIG. 8D. FIG. 8A corresponds to the radiation pattern of the first antenna mode, represented by first arrows 120 in FIG. 5A; FIG. 8B corresponds to the radiation pattern of second antenna mode, represented by second arrows 122 in FIG. 5A; FIG. 8C corresponds to the radiation pattern of third antenna mode, represented by third arrows 124 in FIG. 5B; and where FIG. 8D corresponds to the radiation pattern of fourth antenna mode, represented by fourth arrows 126 in FIG. 5B. Those of ordinary skill in the art will appreciate from FIGS. 8A-8D that the four antenna modes of the antenna element each have a different radiation pattern. In the illustrated embodiment, the resonant frequency of the first mode is 24 GHz, the resonant frequency of the second mode is 28 GHz, the resonant frequency of the third mode is 31 GHz, and the resonant frequency of the fourth mode is 35 GHz. It can be seen from FIGS. 8B and 8D, that the second and fourth antenna modes, in particular, have a desirable end-fire radiation pattern.

In some embodiments of the present disclosure, when the proposed antenna elements 100 are combined into an array, the cumulative radiation pattern of a plurality of antenna elements 100 can result in signals at particular angles experiencing constructive interference while others experience destructive interference. In particular, for example, in some embodiments, the lateral radiation lobes are at least partially suppressed. In this way, radiation patterns from each of the plurality of antenna elements 100 constructively interfere with one another in one or more first direction and destructively interfere with one another in one or more second direction to achieve an aggregate radiation pattern in an end-fire direction.

Figure 9:
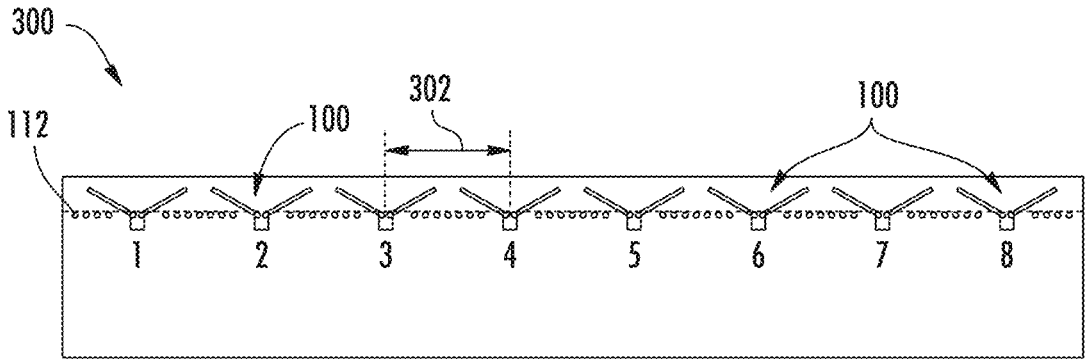
FIG. 9 illustrates a top view of an array of antenna elements according to an embodiment of the presently disclosed subject matter.
Figure 10A:
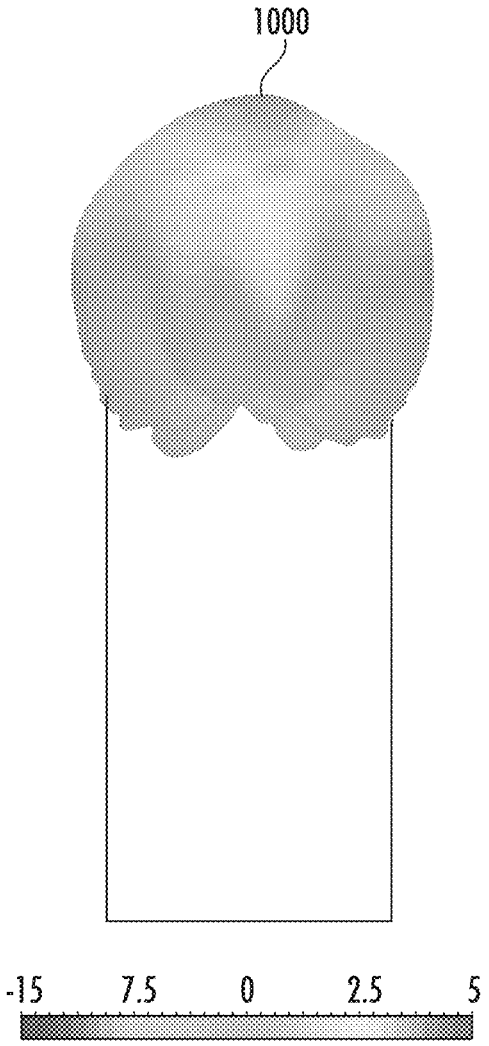
FIGS. 10A-10D are graphs illustrating radiation patterns of an antenna array having eight antenna elements operating in various modes according to an embodiment of the presently disclosed subject matter.
Figure 10B:
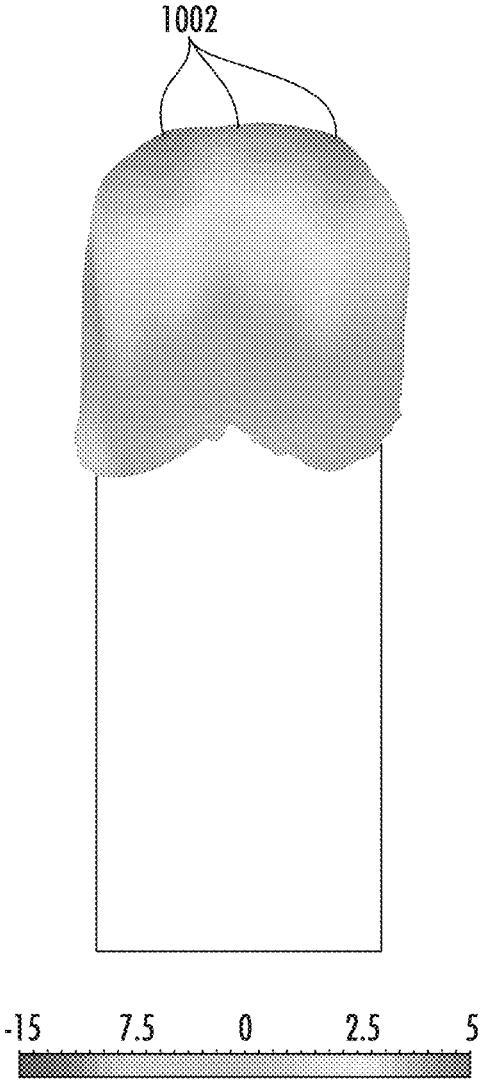
Figure 10C:
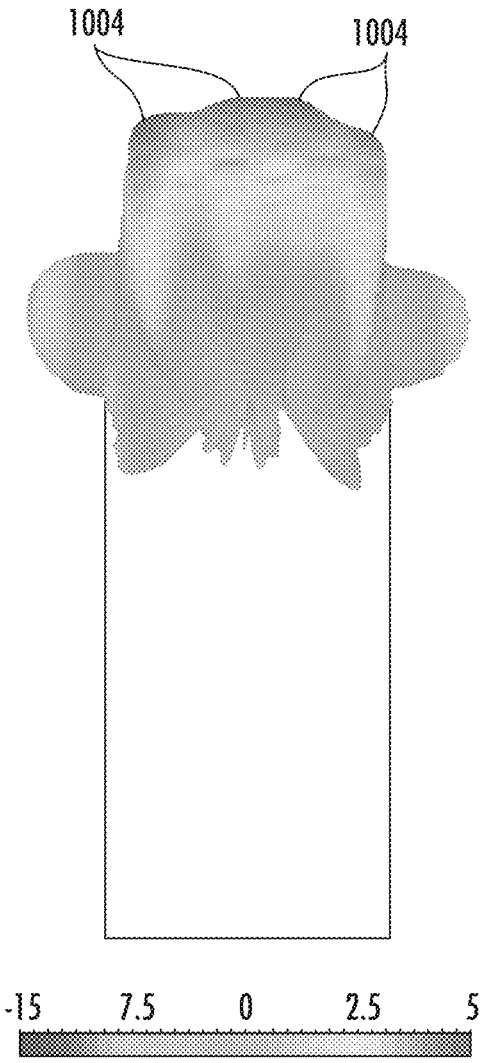
Figure 10D:
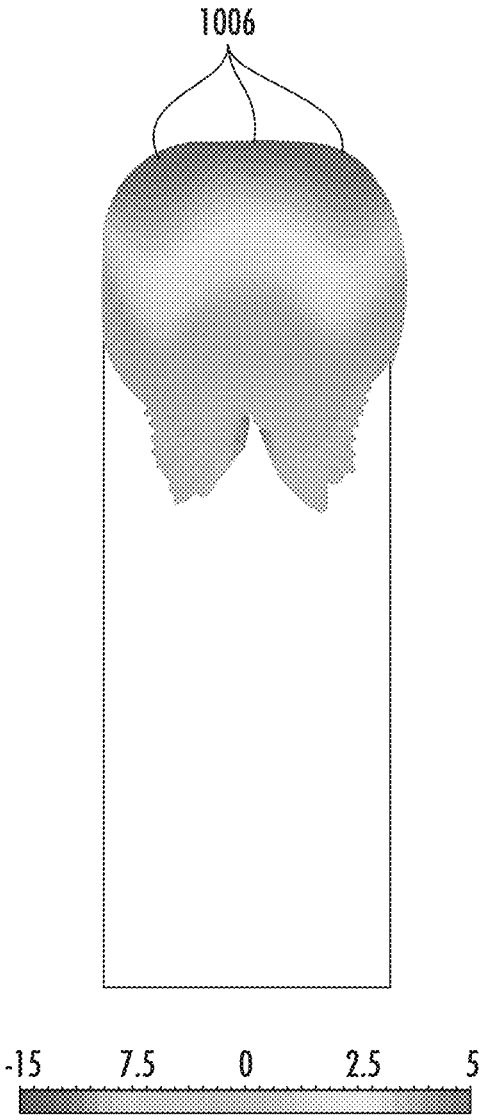
Figure 11B:
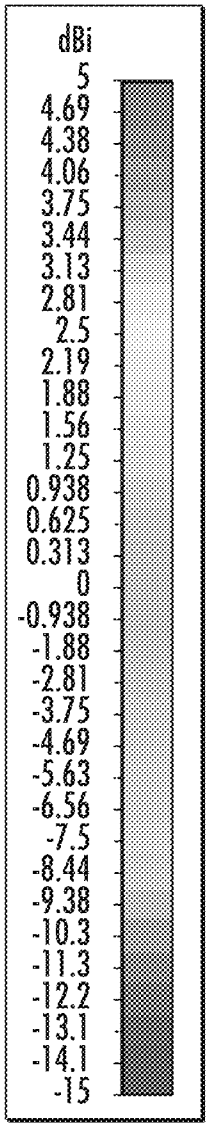
FIGS. 11A-11D are graphs illustrating radiation patterns of an antenna array having two antenna elements operating in various modes according to an embodiment of the presently disclosed subject matter.
Figure 11B:
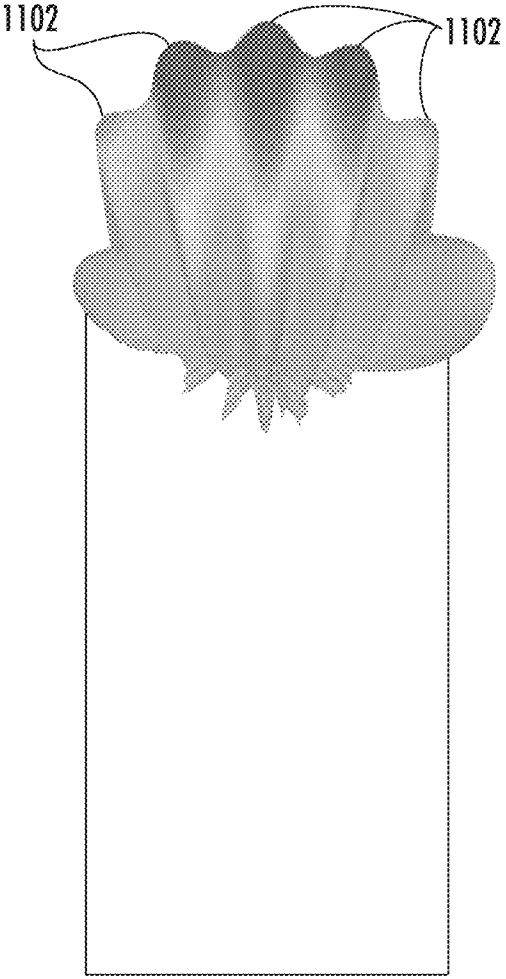
Figure 11A:
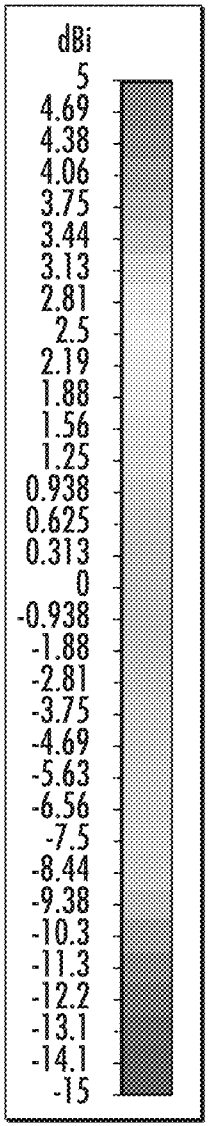
Figure 11A:
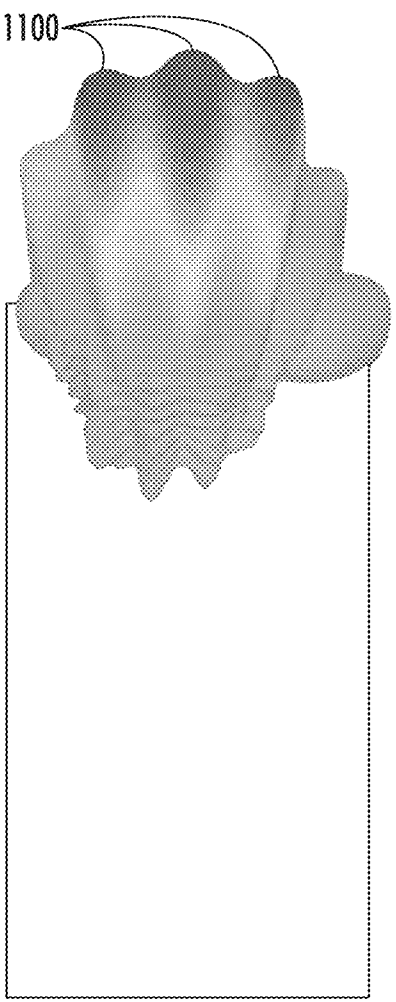
Figure 11D:
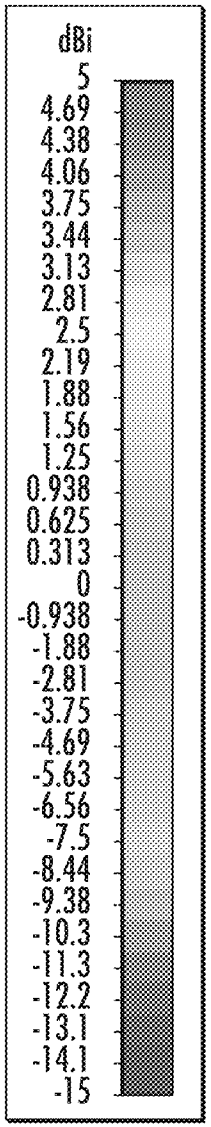
Figure 11D:
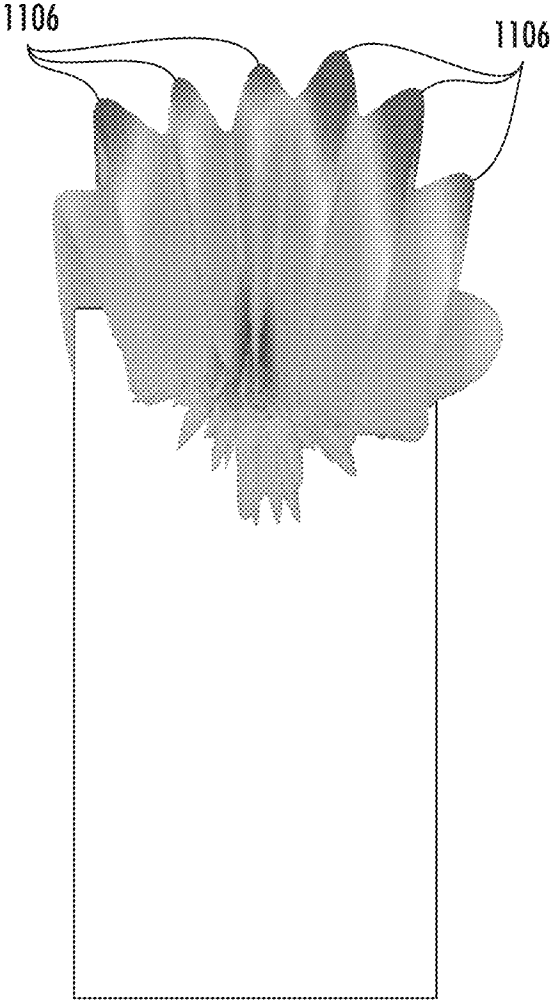
Figure 11C:
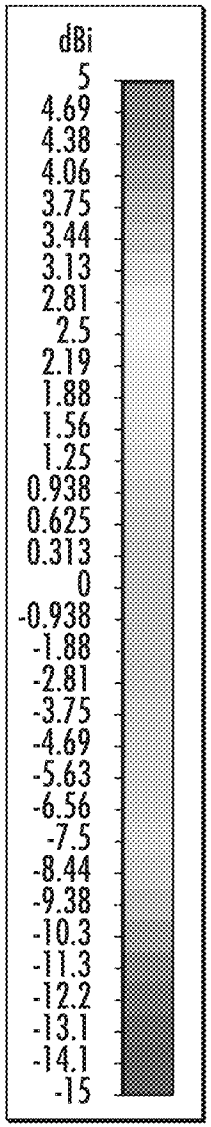
Figure 11C:
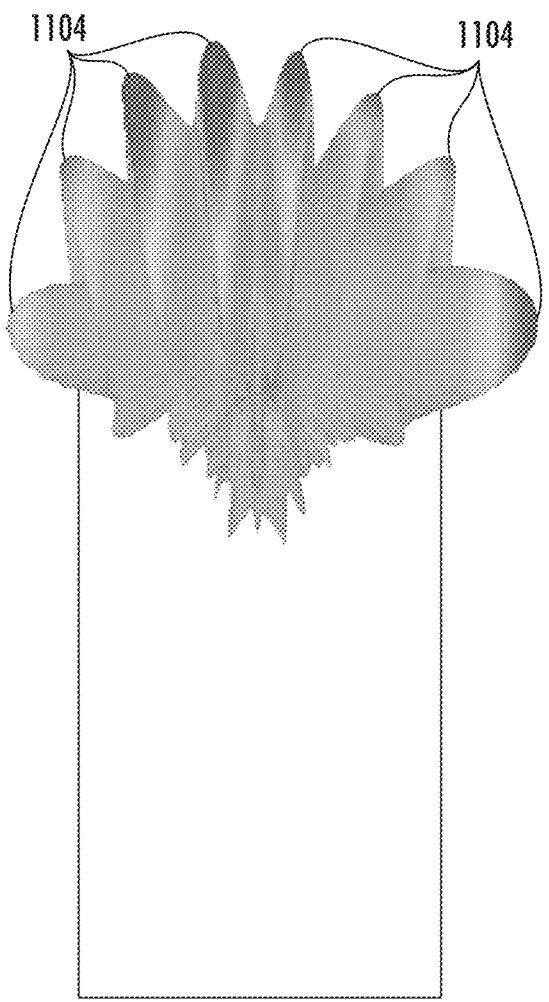
Figure 12B:
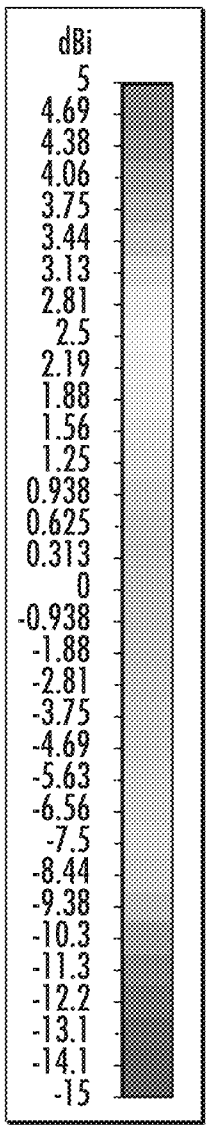
FIGS. 12A-12D are graphs illustrating radiation patterns of an antenna array having three antenna elements operating in various modes according to an embodiment of the presently disclosed subject matter.
Figure 12A:
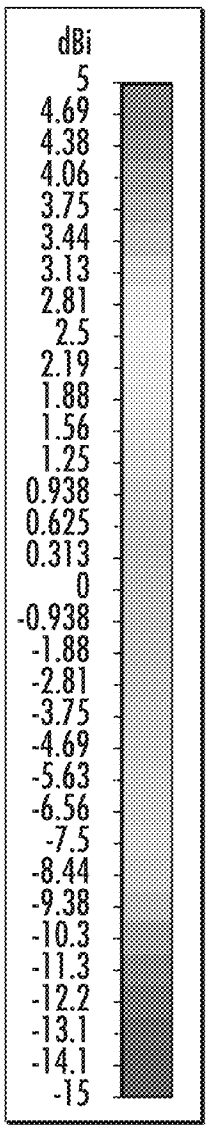
Figure 12D:
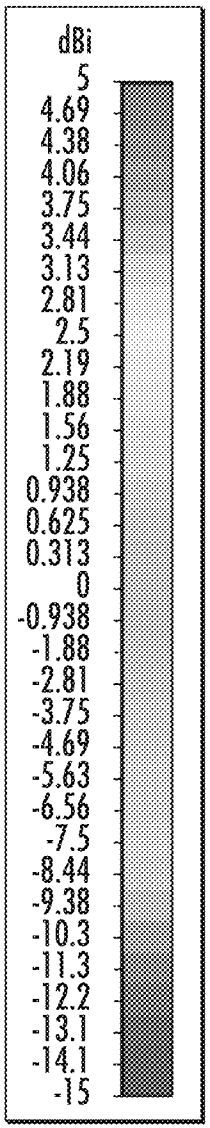
Figure 12D:
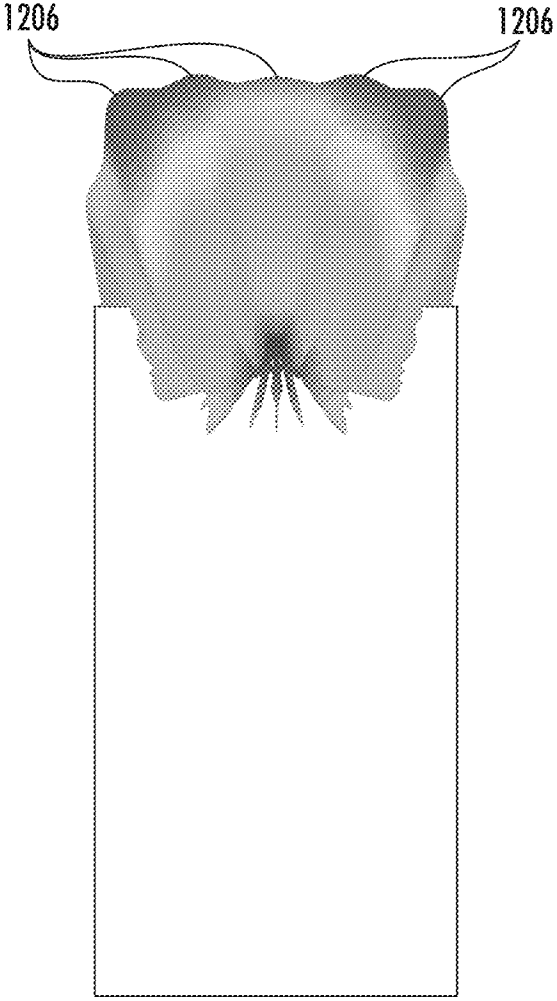
Figure 12C:
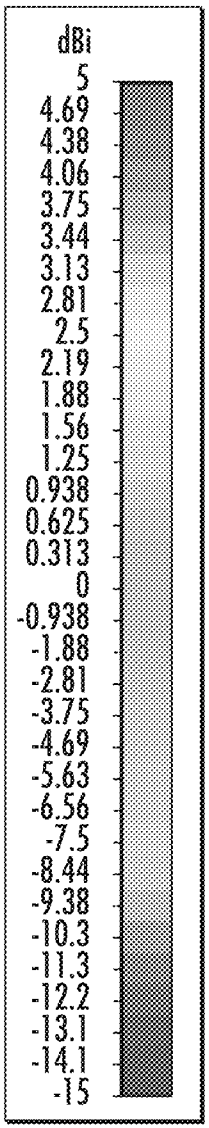
Figure 12C:
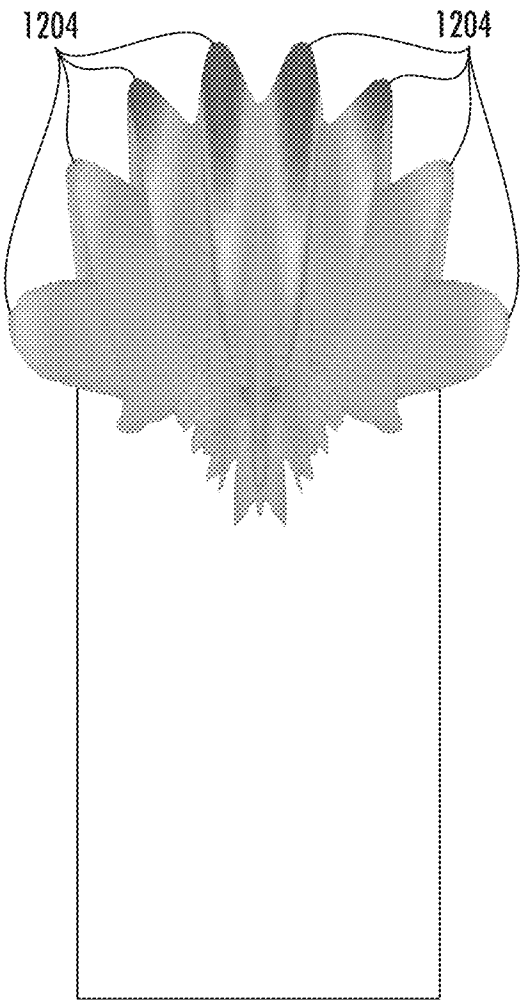

In one embodiment shown in FIG. 9, for example, a plurality of antenna elements 100 are arranged in a substantially linear array 300. In particular, in the illustrated embodiment, eight antenna elements 100 are provided. In FIG. 9, most of the features discussed hereinabove are not labelled so as to keep the image from being cluttered. However, major elements, such as the substrate 102, vias 112, and the individual antenna elements 100 are labelled and comprise the same features as discussed hereinabove. In the exemplary embodiment displayed in FIG. 9, each of the antenna elements 100 are spaced apart by a spacing distance 302. As will be discussed further hereinbelow, in some embodiments of the present disclosure, at a central frequency of 28 GHz, the spacing distance 302 is about 5.5 mm. In some embodiments, as discussed further hereinbelow, the antenna elements 100 can be spaced apart by less than 5.5 mm or greater than 5.5 mm depending on the central frequency.

Radiation patterns for the antenna array 300 illustrated in FIG. 9 above are shown in FIGS. 10A-10D. As illustrated in FIGS. 10A-10D, for example, radiation patterns for antenna array 300 can exhibit a maximum relative power gain, generally designated 1000 in FIG. 10A, 1002 in FIG. 10B, 1004 in FIG. 10C, and 1006 in FIG. 10D, in an end-fire direction. Those having ordinary skill in the art will appreciate, however, that antenna arrays 300 containing different numbers of antenna elements can likewise produce radiation patterns that exhibit corresponding improvements over the single-element radiation pattern depicted by the antenna element 100 in FIG. 1. For example, FIGS. 11A-11D illustrate the radiation pattern produced by an antenna array 300 containing two antenna elements 100. As illustrated in FIGS. 11A-11D, for example, radiation patterns for antenna array 300 can exhibit a maximum relative power gain, generally designated 1100 in FIG. 11A, 1102 in FIG. 11B, 1104 in FIG. 11C, and 1106 in FIG. 11D, in an end-fire direction. FIGS. 12A-12D illustrate the radiation patterns produced by an antenna array 300 containing three antenna elements 100. As illustrated in FIGS. 12A-12D, for example, radiation patterns for antenna array 300 can exhibit a maximum relative power gain, generally designated 1200 in FIG. 12A, 1202 in FIG. 12B, 1004 in FIG. 12C, and 1206 in FIG. 12D, in an end-fire direction. Thus, in some embodiments, the number of antenna elements 100 in the antenna array 300 can be selected to produce a desired balance between the size of the antenna array 300 and the improvement in the gain achieved (see, e.g., the discussion of FIG. 13 hereinbelow). Accordingly, although some examples of different configurations of an antenna array 300 according to the present subject matter are shown and described herein, those having skill in the art will recognize that any of a range of numbers of antenna elements 100 can be arrayed in this manner to achieve a desired aggregate radiation pattern. In many embodiments, for example, the antenna array 300 can include between two and eight antenna elements.

Figure 13:
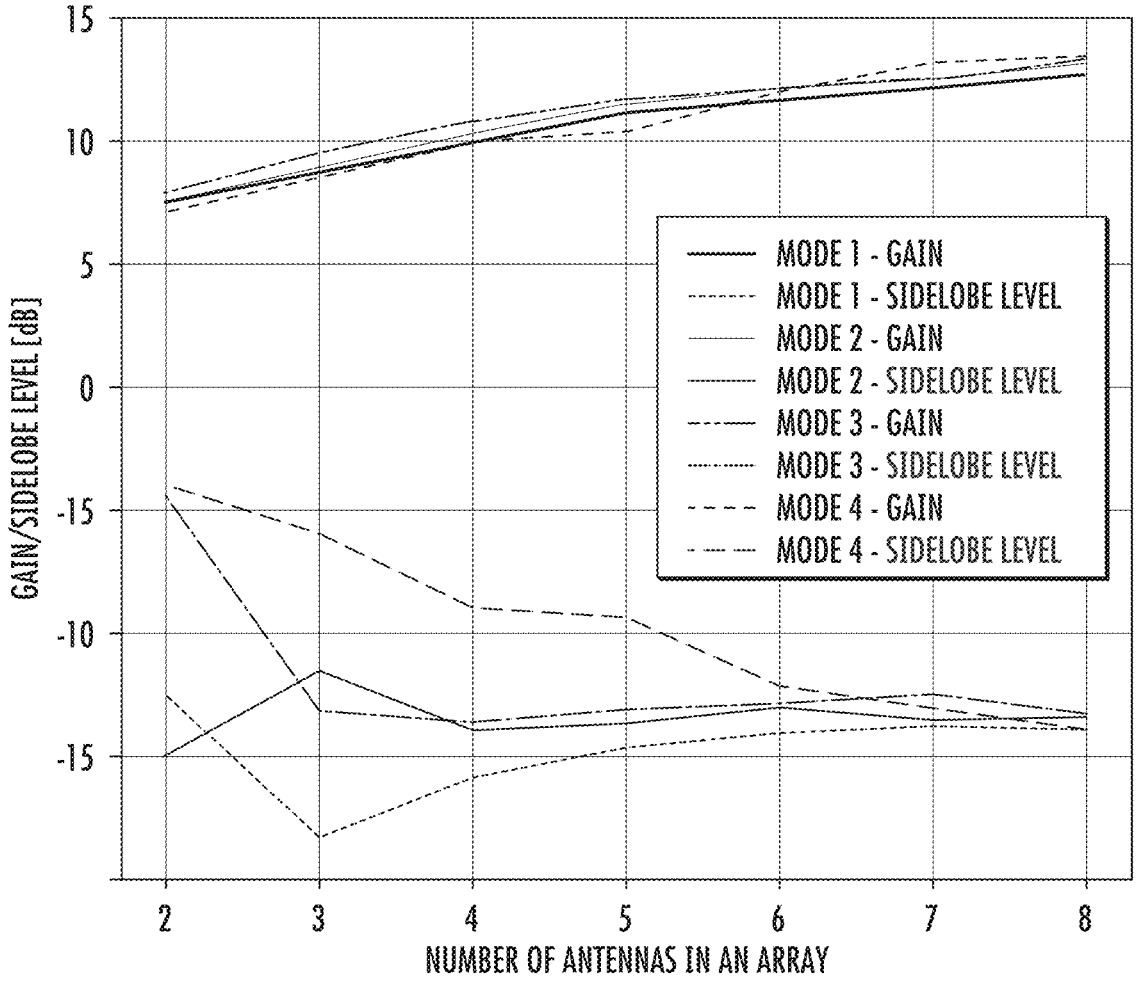
FIG. 13 is a graph illustrating the gain of an antenna array as a function of the number of antenna elements in the array.

FIG. 13 is a graph depicting the gain and sidelobe level (in dB) of an antenna array 300 with a range of two to eight antenna elements 100 for each of the first antenna mode, the second antenna mode, the third antenna mode, and the fourth antenna mode. As illustrated in FIG. 13, relative sidelobe levels would not be appreciably further reduced for antenna arrays 300 having greater than eight antenna elements 100 (e.g., only marginal incremental reductions in sidelobe levels are achieved for antenna arrays 300 of six or more antenna elements 100), although further increases in gain could be achieved with larger antenna arrays 300.

In addition to the number of antenna elements 100 in the antenna array 300 as shown in FIG. 9, the radiation pattern produced can further be controlled by adjusting the spacing distance 302 between adjacent antenna elements 100, which helps to adjust the degree to which the side lobes produced by adjacent antenna elements 100 are suppressed. In particular, adjacent antenna elements 100 of the plurality of multi-mode antenna elements 100 can be spaced apart from each other by a spacing distance 302 that is equal to approximately $\lambda/2$, where $\lambda$ is a wavelength associated with a frequency within a desired operating frequency range of the antenna system. With respect to electromagnetic signals, wavelength, or $\lambda$, is equal to the speed of light in a vacuum in meters per second, divided by the frequency of the wave, where the speed of light is about $299.792\times10^6$ meters/sec. For example, a spacing distance 302 of 5.5 mm between the antenna elements 100 corresponds to roughly a half wavelength, $\lambda/2$, at a frequency of 28 GHz. In order to achieve the broadband antenna array performance, a compromise between inter-element spacing and maximum scan angle can be done. If the antenna elements 100 are too far away, the grating lobe will appear faster at the higher frequencies (e.g., at the third antenna mode and the fourth antenna mode). If the antenna elements 100 are too close, the embedded radiation pattern will be affected, thus reducing performance of the antenna array 300 at the lower frequencies (e.g., at the first antenna mode and the second antenna mode). In addition, these factors can be considered both for the case where the antenna elements 100 are configured for direct end-fire as well as situations in which the beam is steered away. In some embodiments, during beam steering, the sidelobes can become more pronounced.

Figure 14:
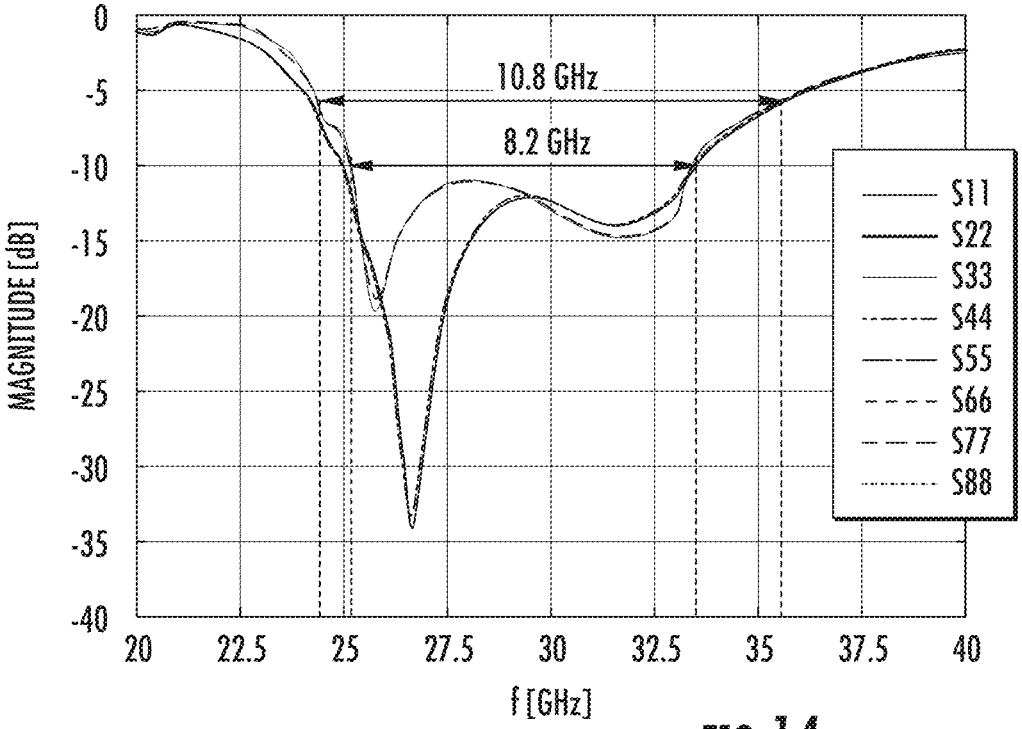
FIG. 14 is a graph illustrating embedded reflection coefficients of an antenna array according to embodiments of the presently disclosed subject matter.
Figure 15:
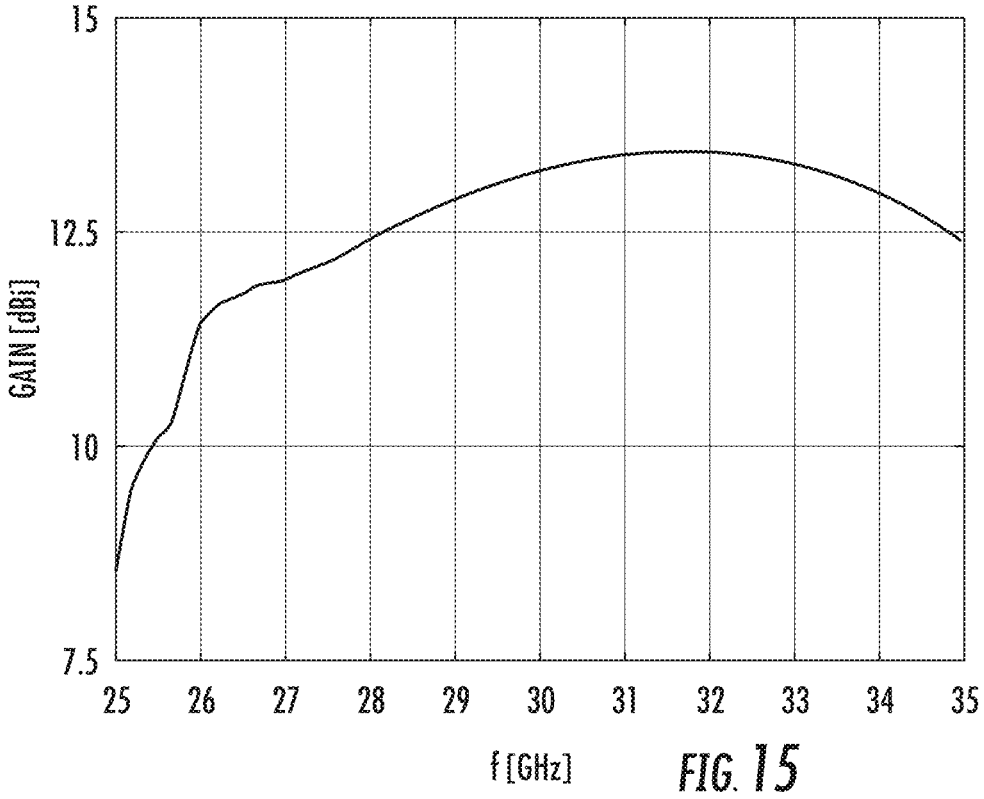
FIG. 15 is a graph illustrating gain over the frequency range of an antenna array according to embodiments of the presently disclosed subject matter.

FIG. 14 shows the resulting reflection coefficient of the eight embedded antenna elements 100 and gain of the antenna array 300 over the frequency band of about 24 GHz to just over 35 GHz. The gain (in dBi) over the frequency range of an exemplary eight element antenna array 300 is shown in FIG. 15. As shown in FIG. 15, the frequency ranges 25 GHz to 35 GHz.

Figure 16A:
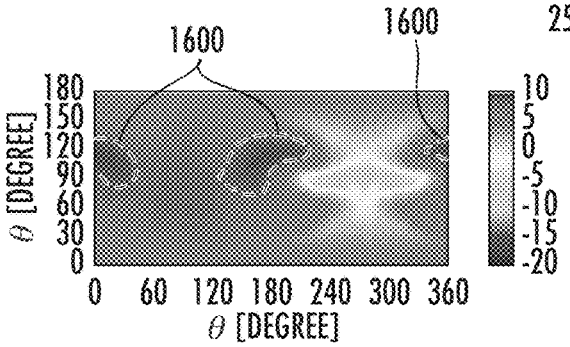
FIG. 16A-16D are graphs illustrating total scan patterns of an antenna array operating in various modes according to an embodiment of the presently disclosed subject matter.
Figure 16B:
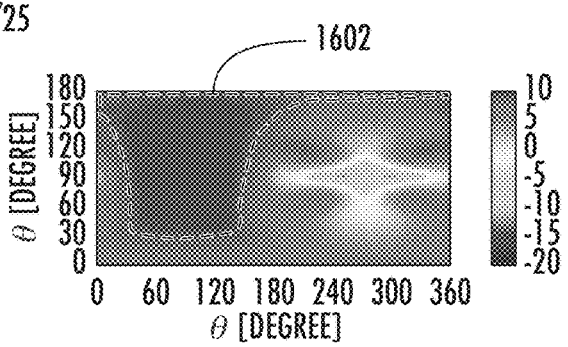
Figure 16C:
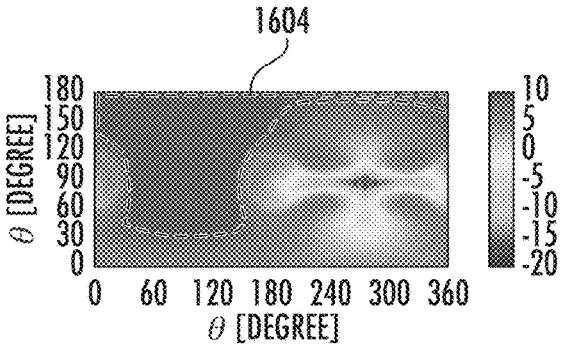
Figure 16D:
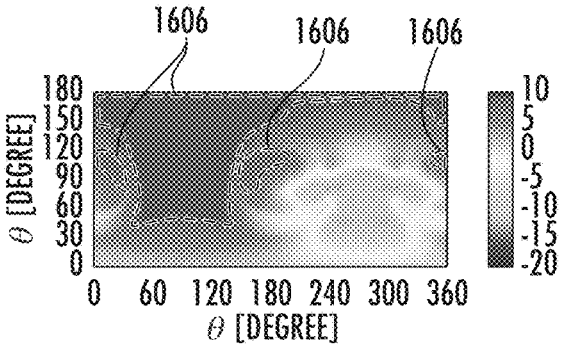

In some embodiments of the present disclosure, when the proposed antenna array 300 is scanned using a progressive phase shift, the total scan patterns (TSP) can be calculated for all of the scan angles. The total scan patterns for the four array element modes are shown in FIGS. 16A-16D. As illustrated in FIGS. 16A-16D, for example, the antenna array 300 can exhibit a maximum relative power gain, generally designated 1600 in FIG. 16A, 1602 in FIG. 16B, 1604 in FIG. 16C, and 1606 in FIG. 16D. All of the total scan patterns look similar, although the TSP for the first mode 120 in FIG. 16A is weaker.

Figure 17:
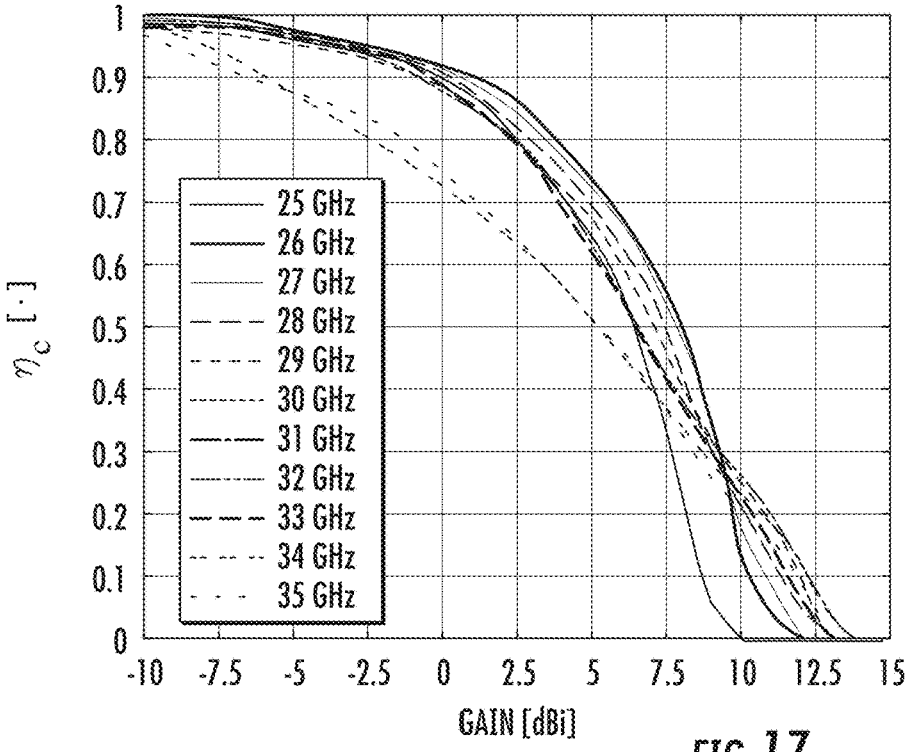
FIG. 17 is a graph illustrating coverage efficiency of an antenna array according to an embodiment of the presently disclosed subject matter in frequency range from 25 GHz to 35 GHz.

Finally, FIG. 17 shows the calculated coverage efficiency of an exemplary eight element antenna array 300 for the frequency range from 25 GHz to 35 GHz with a step of 1 GHz in FIG. 17.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. An antenna system comprising:

one or more multi-mode antenna elements, each of the one or more multi-mode antenna elements comprising a first pair of antenna arms arranged on a first side of a substrate and a second pair of antenna arms arranged on a second side of the substrate, wherein each antenna arm in the first pair of antenna arms is connected together to a corresponding antenna arm of the second pair of antenna arm by a via through the substrate;

wherein each of the one or more multi-mode antenna elements are positioned and configurable to adjust a radiation pattern of the corresponding one or more multi-mode antenna elements; and wherein configurable and positioned includes setting a first angle between the first pair of antenna arms and a second angle between the second pair of antenna arms to adjust the radiation pattern.

2. The antenna system of claim 1, comprising a plurality of multi-mode antenna elements arranged in an array;

wherein each of the plurality of multi-mode antenna elements is positioned with respect to one another and configured such that radiation patterns generated by each antenna arm of each of the multi-mode antenna elements can be adjusted to achieve a desired aggregate radiation pattern.

3. The antenna system of claim 2, wherein adjacent antenna elements of the plurality of multi-mode antenna elements are spaced apart from each other by a distance that is equal to approximately $\lambda/2$, where $\lambda$ is a wavelength associated with a frequency within a desired operating frequency range of the antenna system.

4. The antenna system of claim 2, wherein the plurality of multi-mode antenna elements is arranged in a substantially linear array.

5. The antenna system of claim 2, wherein the array is employed in a phased array to form a desired dynamically steerable radiation pattern.

6. The antenna system of claim 1, wherein the antenna system comprises two to eight multi-mode antenna elements.

7. The antenna system of claim 1, wherein lengths of the first pair of antenna arms, lengths of the second pair of antenna arms, the first angle, and the second angle are selected to define four antenna modes corresponding to different frequencies, the four antenna modes having different current distributions and different radiation patterns.

8. The antenna system of claim 1 further comprising:

a stripline comprising a stripline inner conductor and a stripline outer conductor; and a coaxial cable comprising a coaxial cable inner conductor and a coaxial cable outer conductor;

wherein the stripline is in communication with the one or more multi-mode antenna elements;

wherein the coaxial cable inner conductor connects to the stripline inner conductor and the coaxial cable outer conductor connects to the stripline outer conductor; and wherein the coaxial cable acts as a feedline for the antenna system.

9. The antenna system of claim 1, wherein a distance between the first pair of antenna arms and the second pair of antenna arms is between, and including, about 0.5 mm and 2 mm.

10. An antenna element for use in a multi-mode antenna system, the antenna element comprising;

a first pair of antenna arms arranged on a first side of a substrate, the first pair of antenna arms being arranged at a first angle with respect to one another; and a second pair of antenna arms arranged on a second side of the substrate and connected to the first pair of antenna arms, the second pair of antenna arms being arranged at a second angle with respect to one another;

wherein lengths of the first pair of antenna arms, lengths of the second pair of antenna arms, the first angle, and the second angle are selected to define four antenna modes corresponding to different frequencies; and wherein each arm of the second pair of antenna arms is connected by a via through the substrate to a corresponding arm of the first pair of antenna arms.

11. The antenna element of claim 10, wherein the four antenna modes have different current distributions and different radiation patterns.

12. The antenna element of claim 10, wherein each of the first pair of antenna arms and the second pair of antenna arms is configured to be fed by a differential stripline.

13. The antenna element of claim 10, wherein a distance between the first pair of antenna arms and the second pair of antenna arms is between, and including, about 0.5 mm and 2 mm.

14. A method for achieving an aggregate radiation pattern from an antenna system, the method comprising:

arranging one or more multi-mode antenna elements on a substrate, each of the one or more multi-mode antenna elements comprising a first pair of antenna arms arranged on a first side of a substrate and a second pair of antenna arms arranged on a second side of the substrate, wherein each antenna arm in the first pair of antenna arms is connected together to a corresponding antenna arm of the second pair of antenna arm by a via through the substrate;

wherein each of the one or more multi-mode antenna elements are positioned and configurable to adjust a radiation pattern of the corresponding one or more multi-mode antenna elements; and wherein configurable and positioned includes setting a first angle between the first pair of antenna arms and a second angle between the second pair of antenna arms to adjust the radiation pattern.

15. The method of claim 14, further comprising:

arranging a plurality of the multi-mode antenna elements in an array; and positioning each of the plurality of multi-mode antenna elements with respect to one another and configuring each of the plurality of multi-mode antenna elements such that radiation patterns generated by each antenna arm of each of the multi-mode antenna elements can be adjusted to achieve a desired aggregate radiation pattern.

16. The method of claim 15, wherein arranging the plurality of multi-mode antenna elements in an array comprises arranging between two and eight antenna elements in the array.

17. The method of claim 15, wherein arranging the plurality of multi-mode antenna elements in an array further comprises spacing apart the plurality of multi-mode antenna elements, from each other, by a distance that is equal to approximately $\lambda/2$, where $\lambda$ is a wavelength associated with a frequency within a desired operating frequency range of the antenna system.

18. The method of claim 15, wherein the plurality of multi-mode antenna elements is arranged in a substantially linear array.

19. The method of claim 15, further comprising employing the array in a phased array to form a desired dynamically steerable radiation pattern.

20. The method of claim 14 further comprising:

providing a stripline comprising a stripline inner conductor and a stripline outer conductor; and providing a coaxial cable comprising a coaxial cable inner conductor and a coaxial cable outer conductor;

wherein the stripline is in communication with the one or more multi-mode antenna elements;

wherein the coaxial cable inner conductor connects to the stripline inner conductor and the coaxial cable outer conductor connects to the stripline outer conductor; and wherein the coaxial cable acts as a feedline for the antenna system.

21. The method of claim 14, wherein a distance between the first pair of antenna arms and the second pair of antenna arms is between, and including, about 0.5 mm and 2 mm.

* * * * *